US011022120B2

(12) United States Patent
Nagahara

(10) Patent No.: US 11,022,120 B2
(45) Date of Patent: Jun. 1, 2021

(54) SCROLL COMPRESSOR WITH FIRST AND SECOND COMPRESSION CHAMBERS HAVING FIRST AND SECOND DISCHARGE START POINTS

(71) Applicant: DAIKIN INDUSTRIES, LTD., Osaka (JP)

(72) Inventor: Kenji Nagahara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/069,502

(22) Filed: Oct. 13, 2020

(65) Prior Publication Data

US 2021/0025395 A1 Jan. 28, 2021

Related U.S. Application Data

(63) Continuation of application No. PCT/JP2019/015647, filed on Apr. 10, 2019.

(30) Foreign Application Priority Data

May 7, 2018 (JP) ..... JP2018-089108

(51) Int. Cl.
*F04C 29/02* (2006.01)
*F04C 15/00* (2006.01)
(Continued)

(52) U.S. Cl.
CPC ..... *F04C 29/028* (2013.01); *F04C 18/0215* (2013.01); *F04C 2210/14* (2013.01); *F04C 2210/22* (2013.01)

(58) Field of Classification Search
CPC .... F04C 29/028; F04C 29/0021; F04C 29/02; F04C 18/0215; F04C 18/0253; F04C 18/0261; F04C 23/008; F04C 29/023
See application file for complete search history.

(56) References Cited

U.S. PATENT DOCUMENTS 9,759,216 B2 * 9/2017 Kato ..... F04C 29/026
2013/0209303 A1 8/2013 Tsuka et al.
(Continued)

FOREIGN PATENT DOCUMENTS

JP 5083401 B2 11/2012
JP 2016-160816 A 9/2016

OTHER PUBLICATIONS

International Search Report of corresponding PCT Application No. PCT/JP2019/015647 dated Jul. 16, 2019.
(Continued)

*Primary Examiner* — Deming Wan
(74) *Attorney, Agent, or Firm* — Global IP Counselors, LLP

(57) ABSTRACT

A scroll compressor includes a casing, a low-pressure space and a compression mechanism. The compression mechanism includes fixed and movable scrolls, a fluid chamber including first and second compression chambers, and an adjustment mechanism. The fluid chamber has different discharge start points between the first and second compression chambers. An oil inflow groove is formed in one sliding surface, and an oil relief passage is formed in the other sliding surface. The oil relief passage includes a communication portion that communicates with the oil inflow groove in a predetermined angular range, lubricating oil flowing from the oil inflow groove into the low-pressure space through the communication portion. The predetermined angular range is from a position between a discharge start point of the first compression chamber and a discharge start point of the second compression chamber to a position after the discharge start of the second compression chamber.

19 Claims, 13 Drawing Sheets

(51) Int. Cl.

| | |
|---|---|
| ***F04C 18/02*** | (2006.01) |
| ***F04C 23/00*** | (2006.01) |
| ***F04C 29/00*** | (2006.01) |

(56) References Cited

U.S. PATENT DOCUMENTS

| | | | | |
|---|---|---|---|---|
| 2014/0010694 | A1* | 1/2014 | Tsuka | F04C 29/028 418/55.2 |
| 2015/0337839 | A1 | 11/2015 | Tsuka et al. | |
| 2018/0051697 | A1 | 2/2018 | Murakami et al. | |

OTHER PUBLICATIONS

International Preliminary Report of corresponding PCT Application No. PCT/JP2019/015647 dated Nov. 19, 2020.

* cited by examiner

CRANK ANGLE 0° (360°)

CRANK ANGLE 90° (450°)

CRANK ANGLE 180° (540°)

CRANK ANGLE 225° (585°)

CRANK ANGLE 270° (630°)

CRANK ANGLE 315° (675°)

CRANK ANGLE 225° (585°)

CRANK ANGLE 270° (630°)

CRANK ANGLE 315° (675°)

SCROLL COMPRESSOR WITH FIRST AND SECOND COMPRESSION CHAMBERS HAVING FIRST AND SECOND DISCHARGE START POINTS

CROSS-REFERENCE TO RELATED APPLICATIONS

This is a continuation of International Application No. PCT/JP2019/015647 filed on Apr. 10, 2019, which claims priority to Japanese Patent Application No. 2018-089108 filed on May 7, 2018. The entire disclosures of these applications are incorporated by reference herein.

BACKGROUND

Field of Invention

The present disclosure relates to a scroll compressor.

Background Information

There is a scroll compressor as a compressor that compresses fluid (see, for example, JP 2016-160816A). The scroll compressor compresses fluid with a compression mechanism having a fixed scroll and a movable scroll. The fixed scroll includes a disk-shaped fixed-side end plate and a spiral fixed-side wrap. The movable scroll includes a disk-shaped movable-side end plate and a spiral movable-side wrap.

The fixed scroll and the movable scroll are combined such that the fixed-side wrap and the movable-side wrap mesh with each other, and the fixed scroll and the movable scroll each have a sliding surface on which the fixed-side end plate or the movable-side end plate substantially slides via an oil film. In the scroll compressor of Patent Literature 1, an oil inflow groove into which lubricating oil flows is formed in the sliding surface. High-pressure lubricating oil is supplied to the oil inflow groove to lubricate the sliding surface and generate a force to push back the movable scroll against a force that presses the movable scroll against the fixed scroll.

SUMMARY

A first aspect of the present disclosure is based on a scroll compressor.

The scroll compressor includes a casing, a low-pressure space inside the casing, and a compression mechanism housed in the casing. The compression mechanism includes a fixed scroll, a movable scroll, a fluid chamber, and an adjustment mechanism. The fixed scroll includes a fixed-side end plate having a disk shape and a fixed-side wrap having a spiral shape and rising from the fixed-side end plate. The fixed scroll is fixed to the casing. The movable scroll includes a movable-side end plate having a disk shape that substantially slides on the fixed-side end plate, and a movable-side wrap having a spiral shape that rises from the movable-side end plate and has a different circumferential length from the fixed-side wrap. The movable scroll is configured to make an eccentric rotational motion with respect to the fixed scroll while meshing with the fixed scroll. The fluid chamber includes a first compression chamber formed between an inner peripheral surface of the fixed-side wrap and an outer peripheral surface of the movable-side wrap, and a second compression chamber formed between an outer peripheral surface of the fixed-side wrap and an inner peripheral surface of the movable-side wrap. The fluid chamber has different discharge start points between the first compression chamber and the second compression chamber. The adjustment mechanism includes an oil inflow groove formed in one of a fixed-side sliding surface and a movable-side sliding surface where the fixed-side end plate and the movable-side end plate slide with each other, and an oil relief passage is formed in the other one of the fixed-side sliding surface and the movable-side sliding surface. The oil inflow groove is a groove into which high-pressure lubricating oil flows. The oil relief passage includes a communication portion that communicates with the oil inflow groove in a predetermined angular range in a circumferential direction during eccentric rotation of the movable scroll, the lubricating oil flowing from the oil inflow groove into the low-pressure space through the communication portion. A start point of the predetermined angular range is at a position between the discharge start point of the first compression chamber and the discharge start point of the second compression chamber during the eccentric rotational motion of the movable scroll, and an end point of the predetermined angular range is at a position after the discharge start of the second compression chamber.

DETAILED DESCRIPTION OF EMBODIMENT(S)

First Embodiment

A first embodiment will be described.

Figure 1:
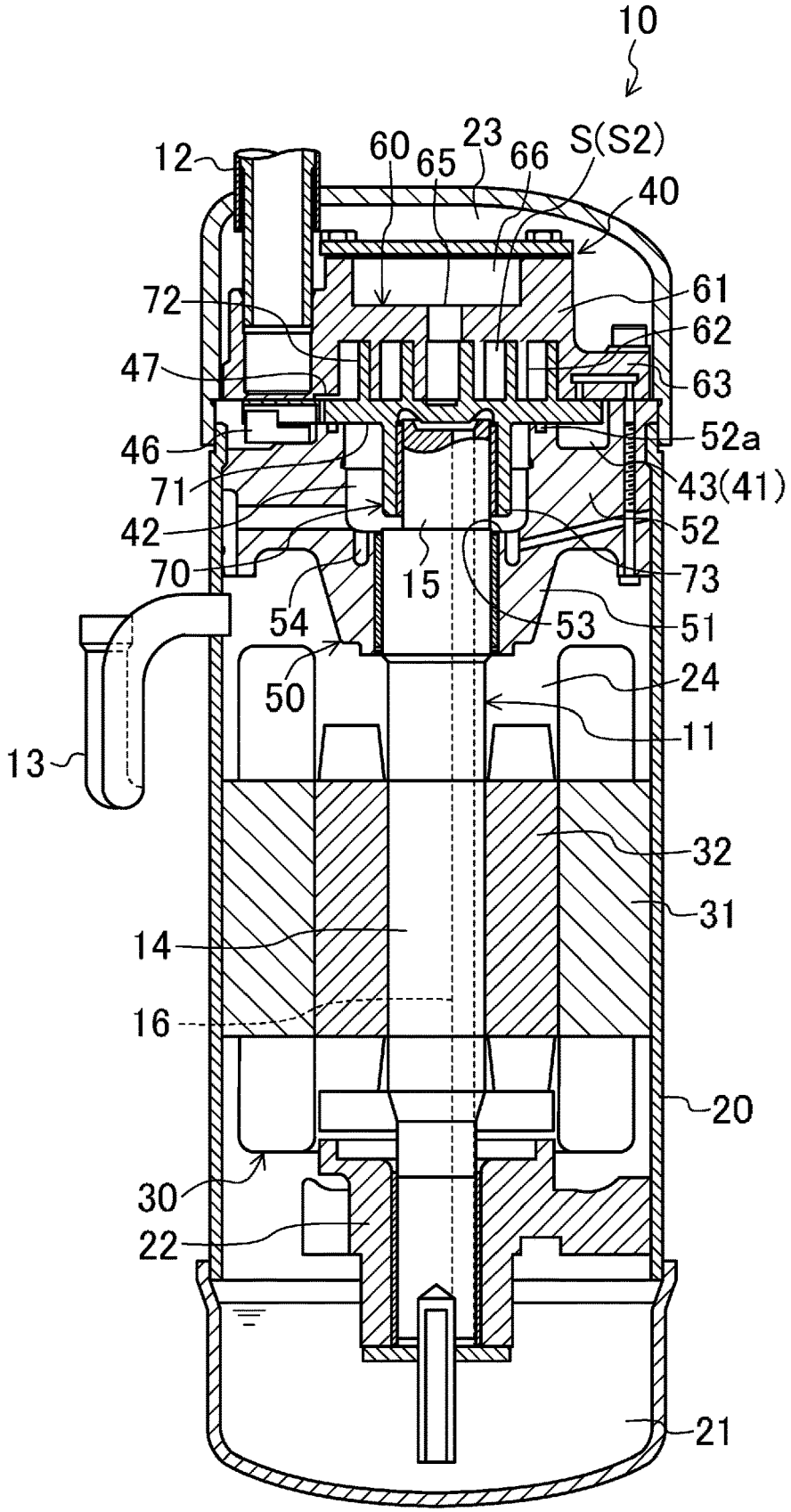
FIG. 1 is a longitudinal sectional view of a scroll compressor according to a first embodiment.
Figure 2:
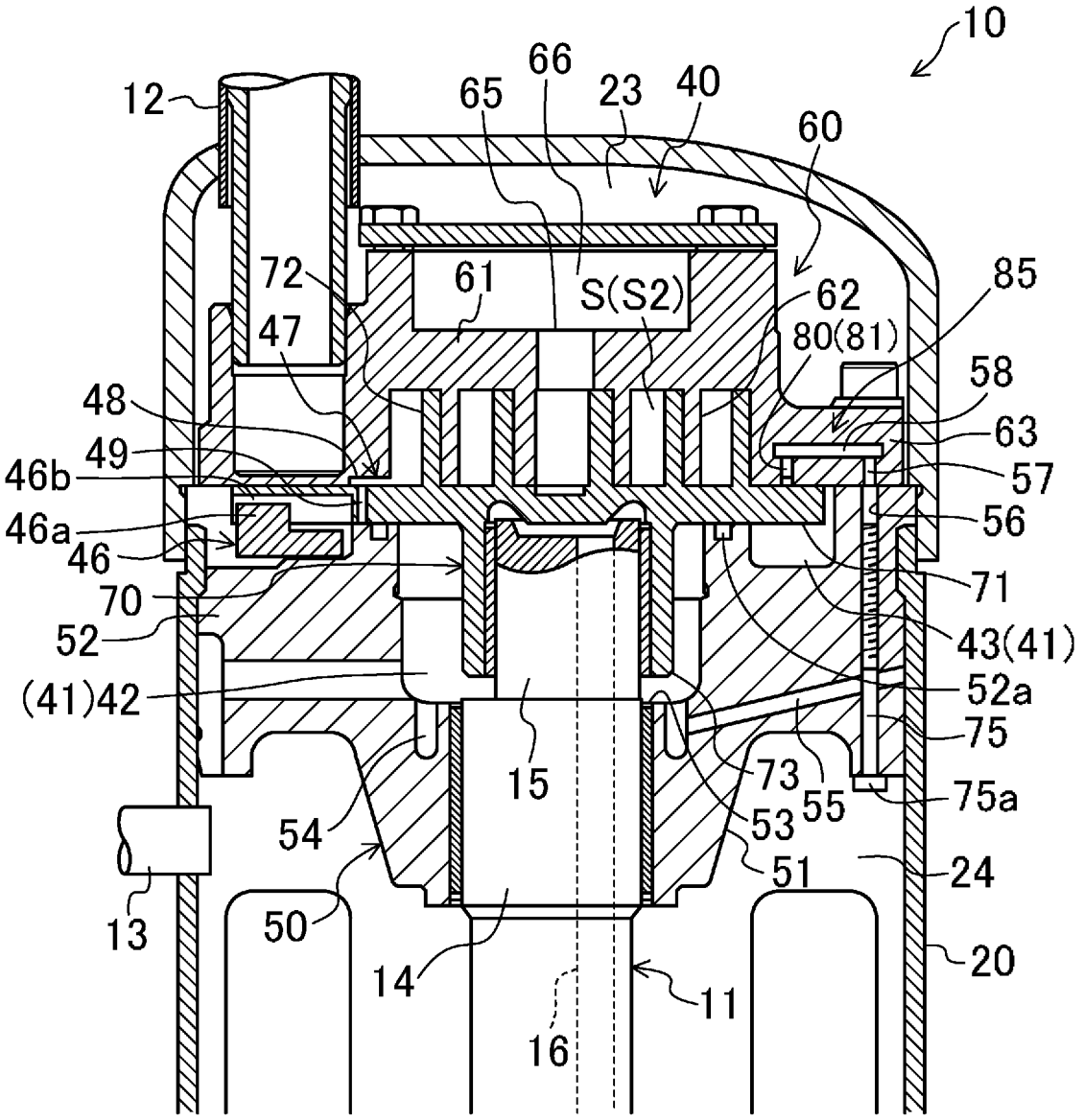
FIG. 2 is a partially enlarged view of a compression mechanism.

As illustrated in FIGS. 1 and 2, a scroll compressor (10) of the present embodiment (hereinafter, also referred to simply as the compressor (10)) is provided in a refrigerant circuit (not illustrated) of a vapor compression refrigeration cycle. The compressor (10) compresses refrigerant serving as working fluid. In the refrigerant circuit, the refrigerant compressed in the compressor (10) condenses in a condenser, is decompressed in a decompression mechanism, evaporates in an evaporator, and is sucked into the compressor (10).

The scroll compressor (10) includes a casing (20), and a motor (30) and a compression mechanism (40) that are housed in the casing (20). The casing (20) is formed in a vertically elongated cylindrical shape as well as a closed dome type.

The motor (30) includes a stator (31) fixed to the casing (20) and a rotor (32) disposed on the inner side of the stator (31). The rotor (32) is fixed to a drive shaft (11) that penetrates the rotor (32).

An oil reservoir (21) for storing lubricating oil is formed at the bottom of the casing (20). A suction pipe (12) penetrates an upper part of the casing (20). A discharge pipe (13) penetrates a central part of the casing (20).

A housing (50) disposed above the motor (30) is fixed to the casing (20). The compression mechanism (40) is disposed above the housing (50). An inflow end of the discharge pipe (13) is located between the motor (30) and the housing (50).

The drive shaft (11) extends vertically along the center axis of the casing (20). The drive shaft (11) includes a main shaft portion (14) and an eccentric portion (15) coupled to the upper end of the main shaft portion (14). A lower part of the main shaft portion (14) is rotatably supported by a lower bearing (22). The lower bearing (22) is fixed to the inner peripheral surface of the casing (20). An upper part of the main shaft portion (14) penetrates the housing (50) and is rotatably supported by an upper bearing (51) of the housing (50). The upper bearing (51) is fixed to the inner peripheral surface of the casing (20).

The compression mechanism (40) includes a fixed scroll (60) and a movable scroll (70) that meshes with the fixed scroll (60). The fixed scroll (60) is fixed to the casing (20) by being fixed to the upper surface of the housing (50). The movable scroll (70) is disposed between the fixed scroll (60) and the housing (50).

An annular portion (52) and a recess (53) are formed in the housing (50). The annular portion (52) is formed in an outer peripheral portion of the housing (50). The recess (53) is formed in a central upper part of the housing (50), and thus the housing (50) is formed in a dish shape with the center thereof recessed. The upper bearing (51) is formed below the recess (53).

The housing (50) is fixed inside the casing (20) through press fitting. In other words, the inner peripheral surface of the casing (20) and the outer peripheral surface of the annular portion (52) of the housing (50) are in close contact with each other in an airtight manner over the entire circumference. The housing (50) partitions the interior of the casing (20) into an upper space (23) for housing the compression mechanism (40) and a lower space (24) for housing the motor (30).

The fixed scroll (60) includes a disk-shaped fixed-side end plate (61), a substantially cylindrical outer peripheral wall (63), and a spiral (involute) fixed-side wrap (62). The outer peripheral wall (63) rises from the outer edge on the front surface (lower surface in FIGS. 1 and 2) of the fixed-side end plate (61). The fixed-side wrap (62) rises on the inner side of the outer peripheral wall (63) of the fixed-side end plate (61). The outer peripheral wall (63) constitutes a part of the fixed-side end plate (61) that closes a fluid chamber (S) described below. The outer peripheral wall (63) is located on the outer peripheral side of the fixed scroll (60) and is formed continuously from the fixed-side wrap (62). The front end surface of the fixed-side wrap (62) and the front end surface of the outer peripheral wall (63) are formed to be substantially flush with each other. The fixed scroll (60) is fixed to the housing (50).

The movable scroll (70) includes a disk-shaped movable-side end plate (71), a spiral (involute) movable-side wrap (72), and a boss portion (73). The movable-side end plate (71) substantially slides on the fixed-side end plate (61) via an oil film. The movable-side wrap (72) is formed on the front surface (upper surface in FIGS. 1 and 2) of the movable-side end plate (71). The boss portion (73) is formed at a central part on the rear surface of the movable-side end plate (71). The eccentric portion (15) of the drive shaft (11) is inserted into the boss portion (73), that is, the drive shaft (11) is coupled to the boss portion (73). The movable-side wrap (72) has a circumferential length different from that of the fixed-side wrap (62). The movable scroll (70) makes an eccentric rotational motion with respect to the fixed scroll (60) while meshing with the fixed scroll (60).

In the compression mechanism (40), the fluid chamber (S), into which the refrigerant flows, is formed between the fixed scroll (60) and the movable scroll (70). The movable scroll (70) is installed such that the movable-side wrap (72) meshes with the fixed-side wrap (62) of the fixed scroll (60). A suction port (64) is formed in the outer peripheral wall (63) of the fixed scroll (60) (see FIG. 3). The downstream end of the suction pipe (12) is connected to the suction port (64).

The fluid chamber (S) is divided into a suction chamber (S1) and a compression chamber (S2). More specifically, when the inner peripheral surface of the outer peripheral wall (63) of the fixed scroll (60) and the outer peripheral surface of the movable-side wrap (72) of the movable scroll (70) substantially come into contact, a contact portion (C) is formed. The fluid chamber (S) is thus divided into the suction chamber (S1) and the compression chamber (S2) with the contact portion (C) therebetween (see, for example, FIG. 3). The suction chamber (S1) constitutes a space into which low-pressure refrigerant is sucked. The suction chamber (S1) communicates with the suction port (64) and is closed off from the compression chamber (S2). The compression chamber (S2) constitutes a space for compressing the low-pressure refrigerant. The compression chamber (S2) is closed off from the suction chamber (S1).

The compression chamber (S2) includes a first compression chamber (S21) formed between the inner peripheral surface of the fixed-side wrap (62) and the outer peripheral surface of the movable-side wrap (72), and a second compression chamber (S22) formed between the outer peripheral surface of the fixed-side wrap (62) and the inner peripheral surface of the movable-side wrap (72). This compression mechanism (40) has an asymmetric spiral structure in which the fixed-side wrap (62) and the movable-side wrap (72) have different circumferential lengths, and the first compression chamber (S21) and the second compression chamber (S22) have different discharge start points (D1, D2).

A discharge port (65) is formed in the center of the fixed-side end plate (61) of the fixed scroll (60). A high-pressure chamber (66) is formed on the rear surface (upper surface in FIGS. 1 and 2) of the fixed-side end plate (61) of the fixed scroll (60). The discharge port (65) opens into the high-pressure chamber (66). The high-pressure chamber (66) communicates with the lower space (24) through passages (not illustrated) formed in the fixed-side end plate (61) of the fixed scroll (60) and the housing (50). High-pressure refrigerant compressed in the compression mechanism (40) flows into the lower space (24). Therefore, the lower space (24) has a high-pressure atmosphere inside the casing (20).

An oil supply passage (16) is formed inside the drive shaft (11), and extends vertically from the lower end to the upper end of the drive shaft (11). A lower end portion of the drive shaft (11) is immersed in the oil reservoir (21). The lubricating oil in the oil reservoir (21) is supplied to the lower bearing (22) and the upper bearing (51) and to the sliding surface between the boss portion (73) and the eccentric portion (15) of the drive shaft (11) through the oil supply passage (16). The oil supply passage (16) opens at the upper end surface of the eccentric portion (15) of the drive shaft (11), and the lubricating oil is supplied to above the eccentric portion (15) of the drive shaft (11) through the oil supply passage (16).

A seal groove (52*a*) extending in the circumferential direction is formed in the upper surface of the inner peripheral portion of the annular portion (52) of the housing (50), and a seal member (not illustrated) is provided in the seal groove (52*a*). A first back pressure portion (42) as a high-pressure space is formed on the inner peripheral side of the seal member. A second back pressure portion (43) as an intermediate-pressure space is formed on the outer peripheral side of the seal member. The first back pressure portion (42) and the second back pressure portion (43) constitute a back pressure space (41). The first back pressure portion (42) is mainly constituted by the recess (53) in the housing (50). The oil supply passage (16) of the drive shaft (11) communicates with the recess (53) through the inside of the boss portion (73) of the movable scroll (70). A high pressure corresponding to the discharge pressure of the compression mechanism (40) acts on the first back pressure portion (42). The back pressure space (41) presses the movable scroll (70) against the fixed scroll (60) by means of the combined pressing forces generated by the high pressure of the first back pressure portion (42) and the intermediate pressure of the second back pressure portion (43).

The second back pressure portion (43) communicates with the upper space (23) through a gap between the casing (20) and the outer peripheral wall (63) of the fixed-side end plate (61) of the fixed scroll (60). The upper space (23) is also an intermediate-pressure space.

An Oldham ring (46) is provided above the housing (50). The Oldham ring (46) is a member that prevents the movable scroll (70) from rotating. The Oldham ring (46) is provided with a horizontally elongated key (46*a*) projecting toward the rear surface of the movable-side end plate (71) of the movable scroll (70) (see FIGS. 2 and 3). Meanwhile, a key groove (46*b*), into which the key (46*a*) of the Oldham ring (46) is slidably fitted, is formed in the rear surface of the movable-side end plate (71) of the movable scroll (70).

As illustrated in FIG. 2, an elastic groove (54), a first oil passage (55), and a second oil passage (56) are formed inside the housing (50). The elastic groove (54) is formed in the bottom surface of the recess (53). The elastic groove (54) is formed in an annular shape so as to surround the periphery of the drive shaft (11). An inflow end of the first oil passage (55) communicates with the elastic groove (54). The first oil passage (55) extends obliquely upward inside the housing (50) from the inner peripheral side toward the outer peripheral side. An inflow end of the second oil passage (56) communicates with a portion of the first oil passage (55) located near the outer periphery. The second oil passage (56) vertically penetrates the inside of the housing (50). A screw member (75) is inserted into the second oil passage (56) from the lower end side of the second oil passage (56). The lower end of the second oil passage (56) is closed by a head portion (75*a*) of the screw member (75).

A third oil passage (57), a fourth oil passage (58), and a vertical hole (81) are formed in the outer peripheral wall (63) of the fixed scroll (60). An inflow end (lower end) of the third oil passage (57) communicates with an outflow end (upper end) of the second oil passage (56). The third oil passage (57) extends vertically inside the outer peripheral wall (63). An inflow end (outer peripheral end) of the fourth oil passage (58) communicates with an outflow end (upper end) of the third oil passage (57). The fourth oil passage (58) extends radially inside the outer peripheral wall (63) of the fixed scroll (60). An inflow end (upper end) of the vertical hole (81) communicates with an outflow end (inner peripheral end) of the fourth oil passage (58). The vertical hole (81) extends downward toward the movable-side end plate (71) of the movable scroll (70). An outflow end of the vertical hole (81) opens at a sliding surface between the movable-side end plate (71) of the movable scroll (70) and the outer peripheral wall (63) of the fixed scroll (60). That is, the vertical hole (81) allows the high-pressure lubricating oil in the recess (53) to be supplied to sliding surfaces (A1, A2) between the movable-side end plate (71) of the movable scroll (70) and the outer peripheral wall (63) of the fixed scroll (60) (part of the fixed-side end plate (61)).

Figure 3:
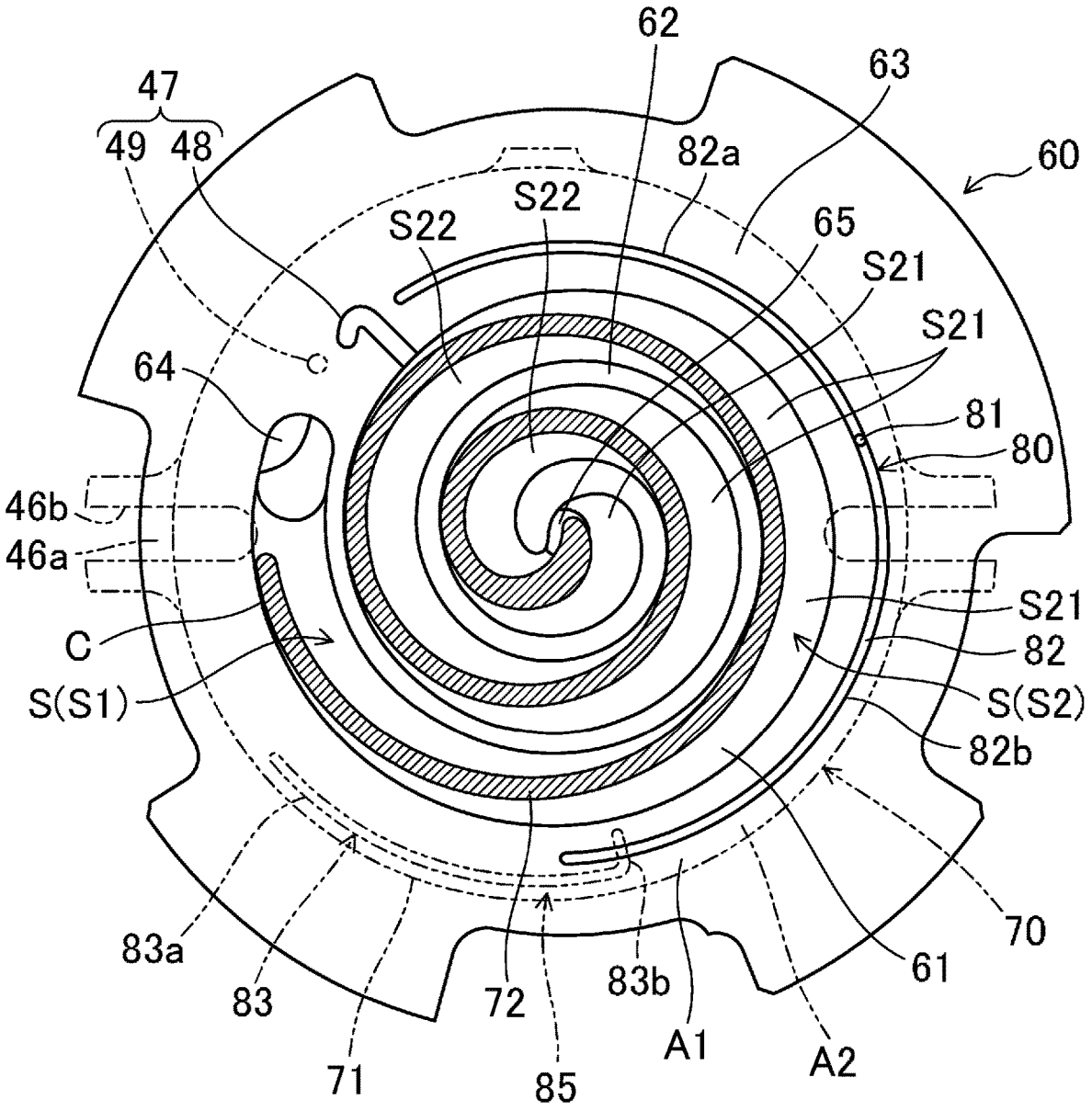
FIG. 3 is a cross-sectional view illustrating a first operation of the compression mechanism.

The fixed scroll (60) and the movable scroll (70) are provided with an adjustment groove (47) for supplying intermediate-pressure refrigerant to the second back pressure portion (43). As illustrated in FIGS. 2 and 3, the adjustment groove (47) includes a primary passage (48) formed in the fixed scroll (60) and a secondary passage (49) formed in the movable scroll (70).

The primary passage (48) is formed in the lower surface of the outer peripheral wall (63) of the fixed scroll (60). The inner end of the primary passage (48) opens at the inner peripheral surface of the outer peripheral wall (63) and communicates with the compression chamber (S2) in an intermediate-pressure state. The secondary passage (49) is a through hole that vertically penetrates an outer peripheral portion of the movable-side end plate (71) of the movable scroll (70). The secondary passage (49) is a round hole having a circular cross section (cross section in a direction perpendicular to the axis). The cross section of the secondary passage (49) is not limited to the circular shape, but may be an elliptical shape or an arc shape, for example.

The upper end of the secondary passage (49) communicates intermittently with the outer end of the primary passage (48). The lower end of the secondary passage (49) communicates with the second back pressure portion (43) between the movable scroll (70) and the housing (50). Therefore, the intermediate-pressure refrigerant is intermittently supplied from the intermediate-pressure compression chamber (S2) to the second back pressure portion (43), and the second back pressure portion (43) has an atmosphere of a predetermined intermediate pressure.

Configuration of Oil Groove and Adjustment Mechanism

As illustrated in FIG. 3, a fixed-side oil groove (oil inflow groove) (80) is formed in the front surface (lower surface in FIG. 2) of the outer peripheral wall (63) of the fixed scroll (60) (part of the end plate (61)). That is, the fixed-side oil groove (80) is formed in the fixed-side sliding surface (A1) of the outer peripheral wall (63) of the fixed scroll (60), the fixed-side sliding surface (A1) facing the movable-side end plate (71) of the movable scroll (70). The fixed-side oil groove (80) includes the vertical hole (81) described above and a circumferential groove (82) that extends while passing through the vertical hole (81).

The circumferential groove (82) extends in a substantially arc shape along the inner peripheral surface of the outer peripheral wall (63) of the fixed scroll (60). The circumferential groove (82) includes a first arc groove (82*a*) and a second arc groove (82*b*). The first arc groove (82*a*) extends from the vertical hole (81) toward one end side (counterclockwise in FIG. 3). The second arc groove (82*b*) extends from the vertical hole (81) toward the other end side (clockwise in FIG. 3). Each of the arc grooves (82*a*, 82*b*) is formed in a range slightly wider than about 90° with respect to the center of the movable scroll (70). The distance between the first arc groove (82*a*) and the inner peripheral surface of the outer peripheral wall (63) gradually increases in the counterclockwise direction in FIG. 3. The distance between the second arc groove (82*b*) and the inner peripheral surface of the outer peripheral wall (63) gradually decreases in the clockwise direction of FIG. 3.

As illustrated in FIG. 3, a movable-side oil groove (oil relief groove) (83) as an oil relief passage is formed in the front surface (upper surface in FIG. 2) of the outer peripheral portion of the movable-side end plate (71) of the movable scroll (70). The movable-side oil groove (83) is formed in the movable-side sliding surface (A2) of the movable-side end plate (71) of the movable scroll (70), the movable-side sliding surface (A2) facing the outer peripheral wall (63) of the fixed scroll (60). The movable-side oil groove (83) is formed near one end of the second arc groove (82*b*) of the fixed scroll (60). The movable-side oil groove (83) includes a movable-side arc groove (83*a*) having a substantially arc shape, and a communication groove (communication portion) (83*b*) that is continuous with one end of the movable-side arc groove (83*a*) (end on the counterclockwise side in FIG. 3).

The movable-side arc groove (83*a*) of the movable-side oil groove (83) extends in a substantially arc shape along the outer peripheral surface of the movable-side end plate (71) of the movable scroll (70) from near the end of the second arc groove (82*b*). The other end of the movable-side arc groove (83*a*) (end on the clockwise side in FIG. 3) extends toward the back side of the key groove (46*b*).

The communication groove (83*b*) extends while bending from the one end of the movable-side arc groove (83*a*) toward the center of the movable scroll (70). That is, the communication groove (83*b*) extends radially inward in the movable-side end plate (71) of the movable scroll (70), and the inner end of the communication groove (83*b*) can communicate with the fluid chamber (S).

As the movable scroll (70) rotates eccentrically, the movable-side oil groove (83) starts or stops communicating with the fixed-side oil groove (80) and the fluid chamber (in this embodiment, the suction chamber (S1)). As a result, the compression mechanism (40) is switched between a state (see FIGS. 3 to 5) and another state (see FIGS. 6 to 8). In the former state, the high-pressure lubricating oil in the fixed-side oil groove (80) is supplied to the movable-side oil groove (83). In the latter state, the high-pressure lubricating oil in the fixed-side oil groove (80) flows into the suction chamber (S1) of the fluid chamber (S) through the communication groove (83*b*) of the movable-side oil groove (83).

As described above, in the present embodiment, the fixed-side oil groove (oil inflow groove) (80), into which the high-pressure lubricating oil flows, is formed in one of the fixed-side sliding surface (A1) and the movable-side sliding surface (A2) (specifically, the fixed-side sliding surface (A1)) on which the fixed-side end plate (61) and the movable-side end plate (71) slide with each other. The movable-side oil groove (83), as the above-mentioned oil relief passage, that communicates with the fixed-side oil groove (80) through the communication groove (83*b*) is formed in the other one of the fixed-side sliding surface (A1) and the movable-side sliding surface (A2) (specifically, the movable-side sliding surface (A2)) on which the fixed-side end plate (61) and the movable-side end plate (71) slide with each other. The movable-side oil groove (83) communicates with the fixed-side oil groove (80) in a part of a circumferential region of the movable scroll (70) (communication section (predetermined angular range) (α) described below) during eccentric rotation of the movable scroll (70). The movable-side oil groove (83) is configured to allow the high-pressure lubricating oil in the fixed-side oil groove (80) to flow into the suction chamber (S1), which is a low-pressure space, of the fluid chamber (S) in the communication section (predetermined angular range) (α). The fixed-side oil groove (80) and the movable-side oil groove (83) constitute an adjustment mechanism (85) that adjusts the pressing force of the movable scroll.

FIGS. 3 to 8 illustrate how the fixed-side wrap (62) and the movable-side wrap (72) mesh with each other at different angles (referred to as a crank angle) when the movable scroll rotates counterclockwise in each drawing. When the outer peripheral edge of the movable-side wrap (72) comes into contact with the inner peripheral surface of the outer peripheral wall (63) of the fixed scroll (60) as illustrated in FIG. 3 (the moment the outermost suction chamber (S1) is completely closed and the first compression chamber (S21) is formed), it is assumed that the crank angle is 0°. In this case, FIGS. 4, 5, 6, 7, and 8 illustrate crank angles of 90°, 180°, 225°, 270°, and 315°, respectively. In this scroll compressor (10), when the drive shaft (crankshaft) (11) rotates 720°, that is, rotates twice from the start of the suction stroke, the compression stroke and the discharge stroke end. This rotation of 720° as one cycle is continuously repeated while a new suction stroke or a new discharge stroke starts every 360° (one rotation of the drive shaft).

Figure 9:
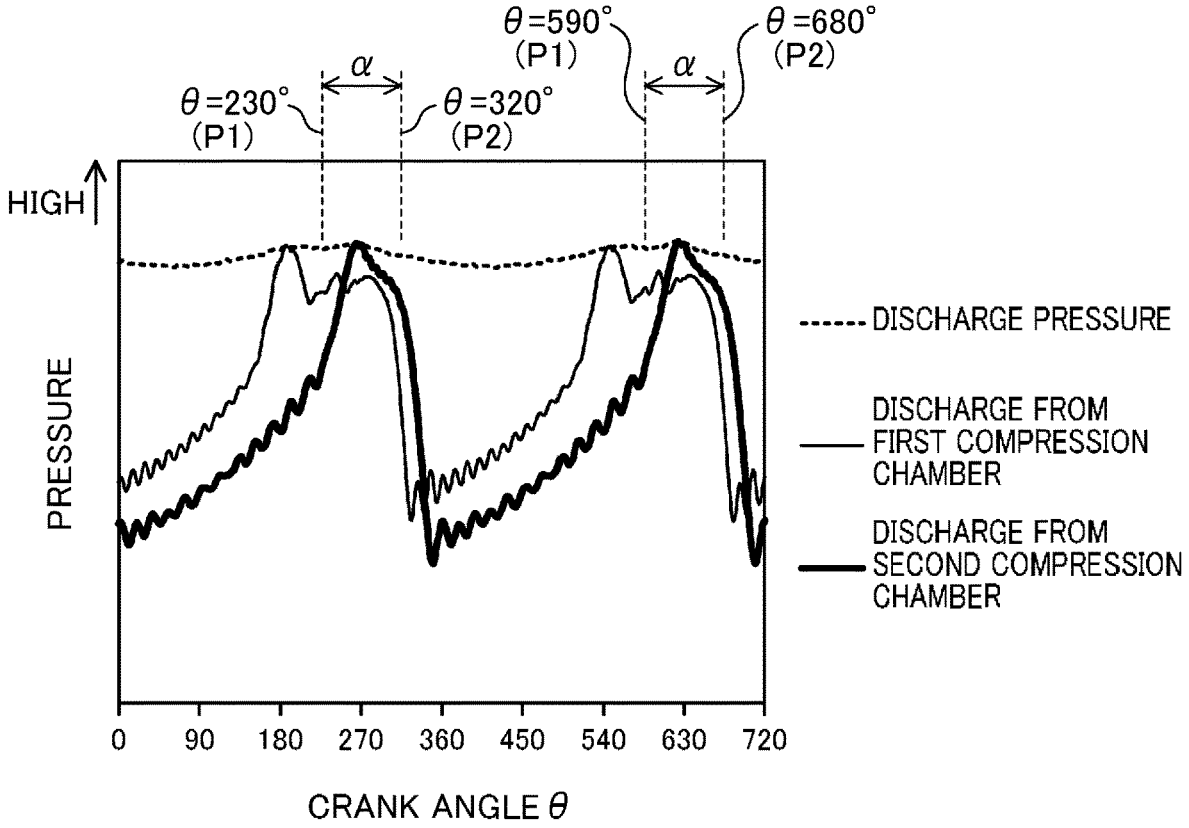
FIG. 9 is a graph illustrating changes in pressure of first and second compression chambers associated with rotation of a drive shaft, the changes being plotted as those of the entire compression mechanism.
Figure 10:
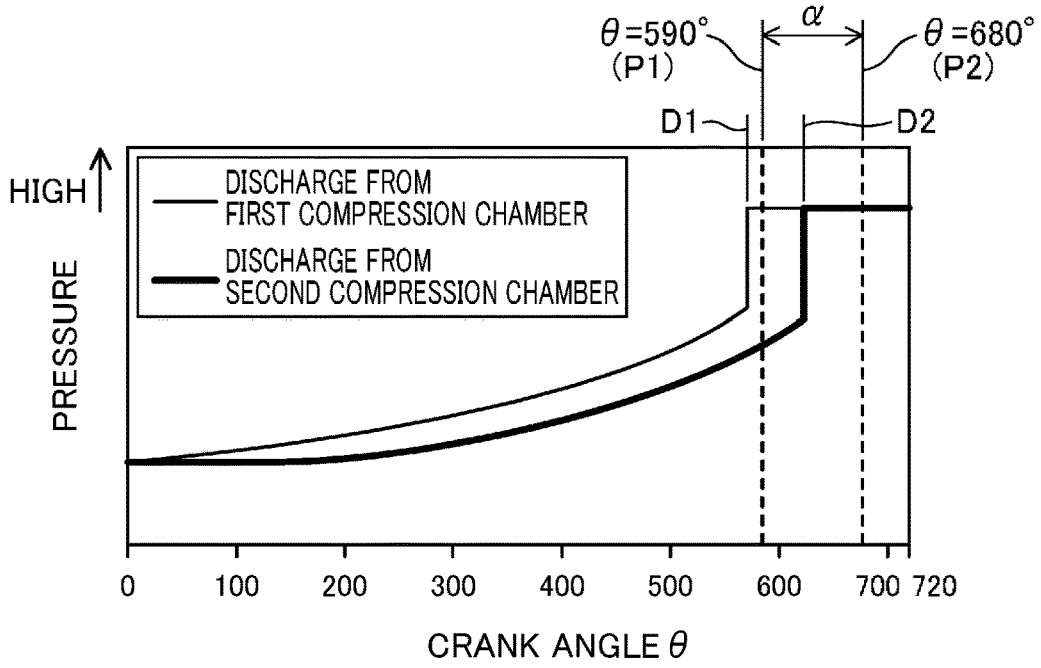
FIG. 10 is a graph illustrating individual changes in pressure of the first and second compression chambers with 720° set as one cycle.
Figure 11:
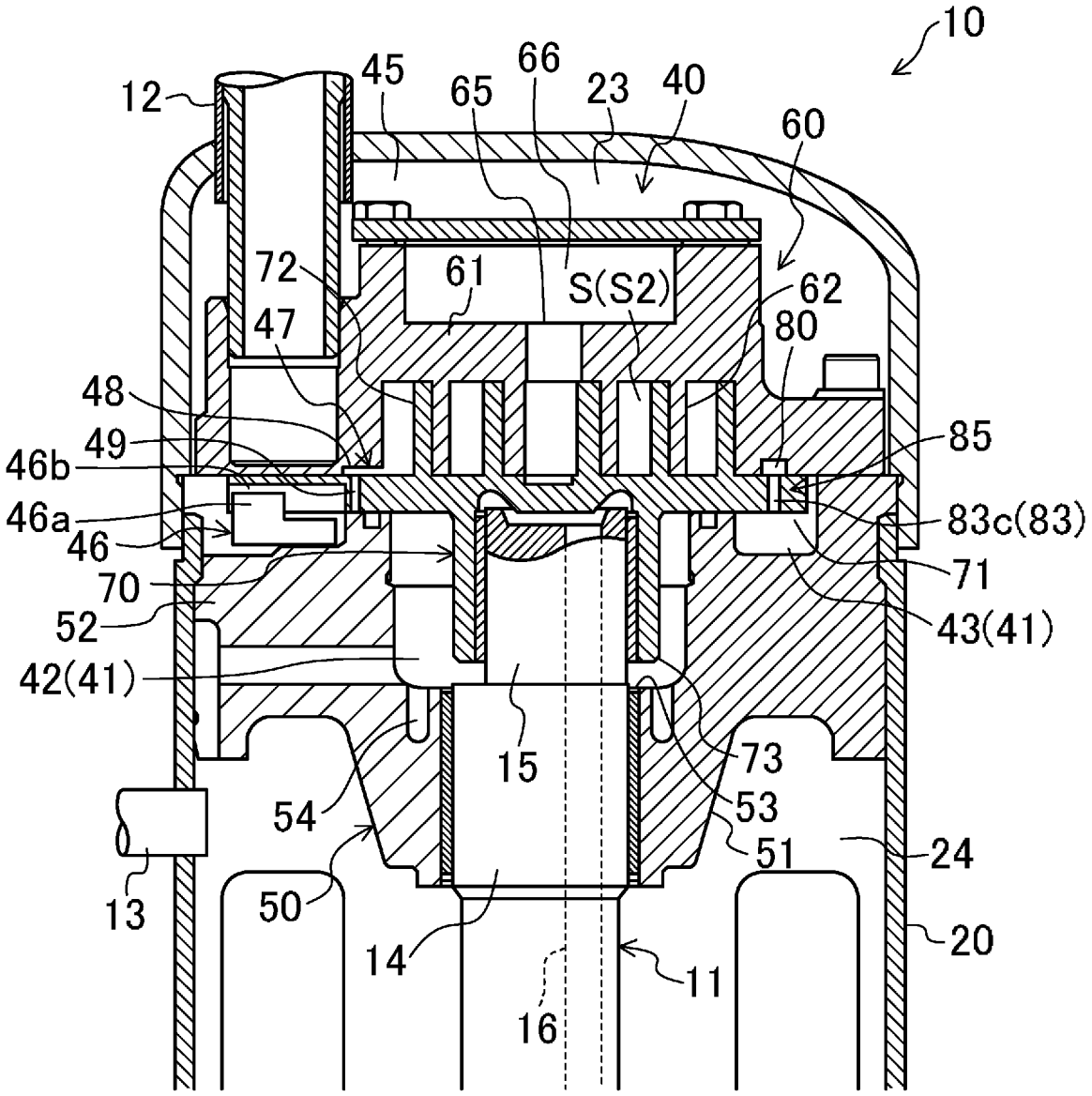
FIG. 11 is a longitudinal sectional view of a scroll compressor according to a second embodiment.

FIG. 9 is a graph illustrating changes in pressure of the first and second compression chambers (S21, S22) associated with the rotation of the drive shaft (crankshaft) (11), the changes being plotted as those of the entire compression mechanism (40). FIG. 10 is a graph illustrating individual changes in pressure of the first and second compression chambers (S21, S22) with 720° set as one cycle. Note that FIG. 10 illustrates changes in pressure under so-called insufficient compression (where the discharge pressure of the compressor (10) is lower than the high pressure of the refrigerant circuit, and the pressure of the refrigerant discharged from the compressor (10) immediately rises to the high pressure of the refrigerant circuit).

A start point (P1) and an end point (P2) of a predetermined communication section (predetermined angular range) (α) during an eccentric rotational motion of the movable scroll (70) are set to the adjustment mechanism (85) such that the movable-side oil groove (83) communicates with the fixed-side oil groove (80) only in that communication section (predetermined angular range) (α). Specifically, as illustrated in FIG. 10, the start point (P1) of the communication section (α) is set between the discharge start point (D1) of the first compression chamber (S21) and the discharge start point (D2) of the second compression chamber (S22) during the eccentric rotational motion of the movable scroll (70), and the end point (P2) of the communication section (α) is set after the discharge start of the second compression chamber (S22).

Only in the communication section (α) does the movable-side oil groove (83) formed in the movable-side sliding surface (A2) allow the tip of the communication groove (83*b*) of the movable-side oil groove (83) to communicate with the suction chamber (S1) of the fluid chamber (S) and allow the fixed-side oil groove (80) to communicate with the suction chamber (S1) of the fluid chamber (S). In the present embodiment, the communication section (α) is set in a range of approximately 230° to 320° (560° to 680°) in terms of a crank angle as illustrated in FIGS. 9 and 10. In other words, the communication section (α) ranges from a position where the drive shaft (11) has rotated about 5° from FIG. 6 to a position where the drive shaft (11) has rotated about 5° from FIG. 8.

In the present embodiment, as illustrated in FIG. 10, the communication section (α) is set such that the discharge start point (D2) of the second compression chamber is in the first half of the communication section (α) during the eccentric rotational motion of the movable scroll.

In the present embodiment, the fixed-side oil groove (80) is formed in an angular range of slightly wider than 180° in the circumferential direction with respect to the center of the fixed-side end plate (61) or the movable-side end plate (71). The flow path cross-sectional area of the movable-side oil groove (oil relief groove) (83) is smaller than the flow path cross-sectional area of the fixed-side oil groove (oil inflow groove) (80).

Operation

First, the basic operation of the compressor (10) will be described.

When the motor (30) is operated, the movable scroll (70) of the compression mechanism (40) is rotationally driven. Since the Oldham ring (46) prevents the movable scroll (70) from rotating, the movable scroll (70) only rotates eccentrically around the axis of the drive shaft (11). As illustrated in FIGS. 3 to 8, when the movable scroll (70) starts rotating eccentrically, the fluid chamber (S) is divided into the suction chamber (S1) and the compression chamber (S2) with the contact portion (C) therebetween. A plurality of the compression chambers (S2) is formed between the fixed-side wrap (62) of the fixed scroll (60) and the movable-side wrap (72) of the movable scroll (70). When the movable scroll (70) rotates eccentrically, these compression chambers (S2) gradually approach the center (discharge port) and the volumes of the compression chambers (S2) decrease. As a result, the refrigerant is compressed in each of the compression chambers (S2).

When the compression chamber (S2) having the smallest volume communicates with the discharge port (65), high-pressure gas refrigerant in the compression chamber (S2) is discharged into the high-pressure chamber (66) through the discharge port (65). The high-pressure refrigerant gas in the high-pressure chamber (66) flows into the lower space (24) through the passages formed in the fixed scroll (60) and the housing (50). The high-pressure gas refrigerant in the lower space (24) is discharged to the outside of the casing (20) through the discharge pipe (13).

Oil Supply Operation and Pressing Force Adjustment Operation by Adjustment Mechanism Next, a lubricating oil supply operation in the compressor (10) and a pressing force adjustment operation of the movable scroll (70) by the adjustment mechanism (85) will be described with reference to FIGS. 2 to 8.

When the high-pressure gas refrigerant flows into the lower space (24) of the compressor (10), the lower space (24) has a high-pressure atmosphere, and the lubricating oil in the oil reservoir (21) also has a high pressure. The high-pressure lubricating oil in the oil reservoir (21) flows upward in the oil supply passage (16) of the drive shaft (11), and flows into the boss portion (73) of the movable scroll (70) through the opening at the upper end of the eccentric portion (15) of the drive shaft (11).

The oil supplied to the boss portion (73) is then supplied to the sliding surface between the eccentric portion (15) of the drive shaft (11) and the boss portion (73). As a result, the first back pressure portion (42) has a high-pressure atmosphere corresponding to the discharge pressure of the compression mechanism (40). The second back pressure portion (43) has an intermediate pressure as described above. The movable scroll (70) is pressed against the fixed scroll (60) by the pressing force generated by the high pressure of the first back pressure portion (42) and the intermediate pressure of the second back pressure portion (43).

The high-pressure oil accumulated in the second back pressure portion (43) flows into the elastic groove (54), flows through the first oil passage (55), the second oil passage (56), the third oil passage (57), and the fourth oil passage (58) in that order, and then flows into the vertical hole (81). As a result, the lubricating oil having a high pressure corresponding to the discharge pressure of the compression mechanism (40) is supplied to the fixed-side oil groove (80). In this state, when the movable scroll (70) rotates eccentrically, the oil in the circumferential groove (82) of the fixed-side oil groove (80) is used to lubricate the fixed-side sliding surface (A1) and the movable-side sliding surface (A2) around the circumferential groove (82).

The flow of oil at each crank angle of FIGS. 3 to 8, and the pressing force adjustment operation of the adjustment mechanism (85) using the flow of oil will be described below.

Crank angle θ=0°(360°)

When the movable scroll (70) is at the crank angle θ=0° (360°) in FIG. 3, which corresponds to the moment the outermost first compression chamber (S21) is formed, for example, the end of the second arc groove (82*b*) of the fixed-side oil groove (80) communicates with the communication groove (83*b*) of the movable-side oil groove (83). Therefore, the high-pressure lubricating oil in the fixed-side oil groove (80) flows into the movable-side oil groove (83) through the communication groove (83*b*). As a result, the communication groove (83*b*) and the movable-side arc groove (83*a*) of the movable-side oil groove (83) are filled with the high-pressure lubricating oil. At this time, the movable-side oil groove (83) and the suction chamber (S1) are closed off from each other. Therefore, the high-pressure lubricating oil in the movable-side oil groove (83) is used to lubricate the fixed-side sliding surface (A1) and the movable-side sliding surface (A2).

At this time, as illustrated in FIGS. 9 and 10, the pressure inside the compression chamber (S2) is low, the movable scroll (70) is hard to overturn, the high pressure of the lubricating oil that has filled the fixed-side oil groove (80) and the movable-side oil groove (83) generates a relatively strong push-back force that pushes back the movable scroll (70) against the pressing force of the back pressure space (41), and the pressing force and the push-back force are balanced.

Crank angle θ=90°(450°)

Figure 4:
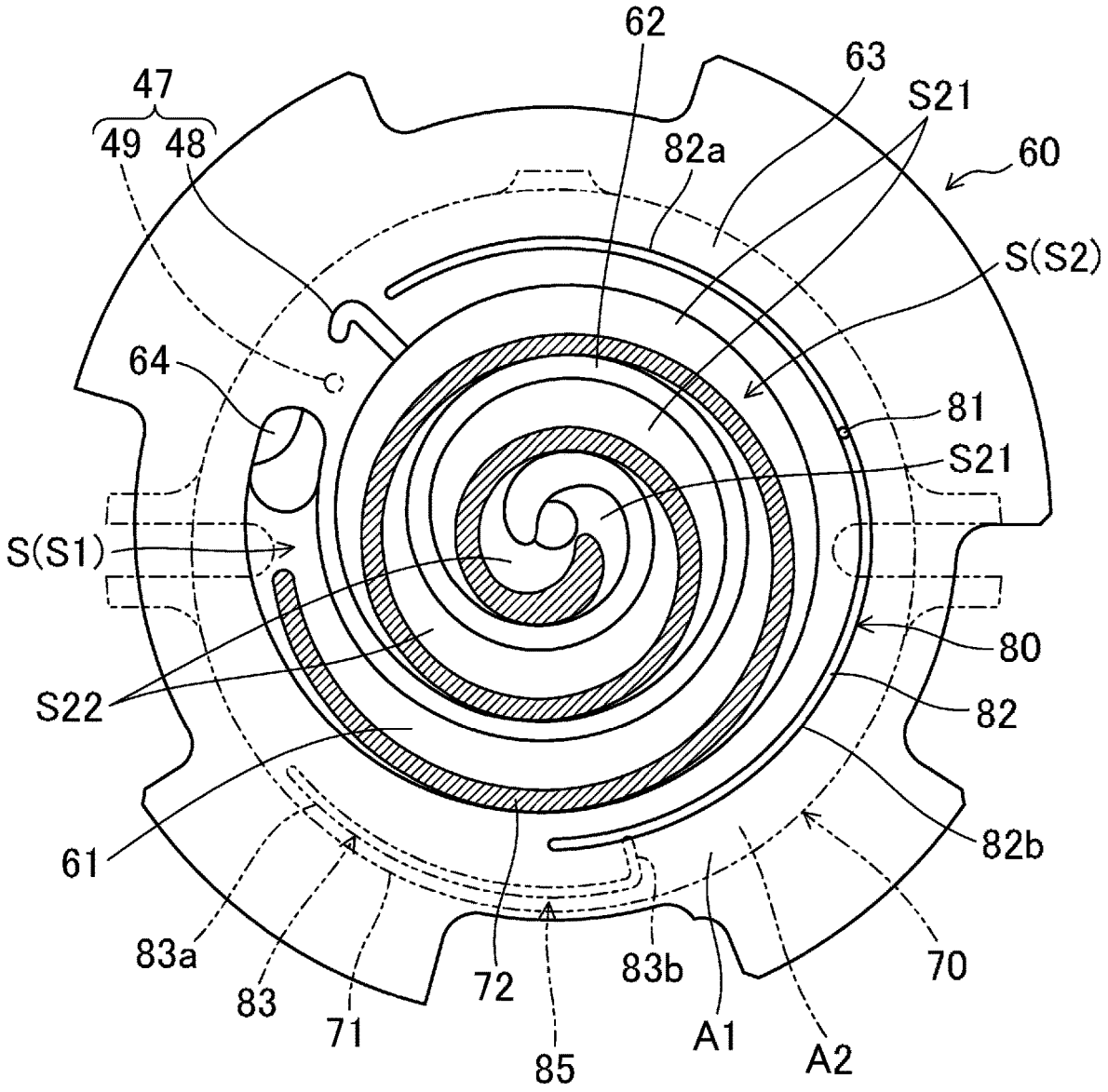
FIG. 4 is a cross-sectional view illustrating a second operation of the compression mechanism.

When the movable scroll (70) further rotates eccentrically from the state of FIG. 3 and reaches the crank angle θ=90° (450°) in FIG. 4, for example, the positional relationship between the fixed-side oil groove (80) and the movable-side oil groove (83) changes. Specifically, the tip of the communication groove (83*b*) moves diagonally downward to the right in the drawing from the position in FIG. 3 to the position in FIG. 4 on the orbit whose radius corresponds to the eccentric amount of the eccentric portion (15) of the drive shaft (11), and the tip of the communication groove (83*b*) keeps communicating with the fixed-side oil groove (80). Even in this state, therefore, as in the state of FIG. 3 where θ=0° (360°), the high-pressure lubricating oil in the fixed-side oil groove (80) flows into the movable-side oil groove (83) through the communication groove (83*b*). As a result, the communication groove (83*b*) and the movable-side arc groove (83*a*) of the movable-side oil groove (83) are filled with the high-pressure lubricating oil. Also at this time, the movable-side oil groove (83) and the suction chamber (S1) are closed off from each other. Therefore, the high-pressure lubricating oil in the movable-side oil groove (83) is used to lubricate the fixed-side sliding surface (A1) and the movable-side sliding surface (A2).

Also at this time, as in the case of the crank angle θ=0° (360°), the pressure inside the compression chamber (S2) is low, the movable scroll (70) is hard to overturn, the high pressure of the lubricating oil that has filled the fixed-side oil groove (80) and the movable-side oil groove (83) generates a relatively strong push-back force that pushes back the movable scroll (70) against the pressing force of the back pressure space (41), and the pressing force and the push-back force are balanced.

Crank angle θ=180°(540°)

Figure 5:
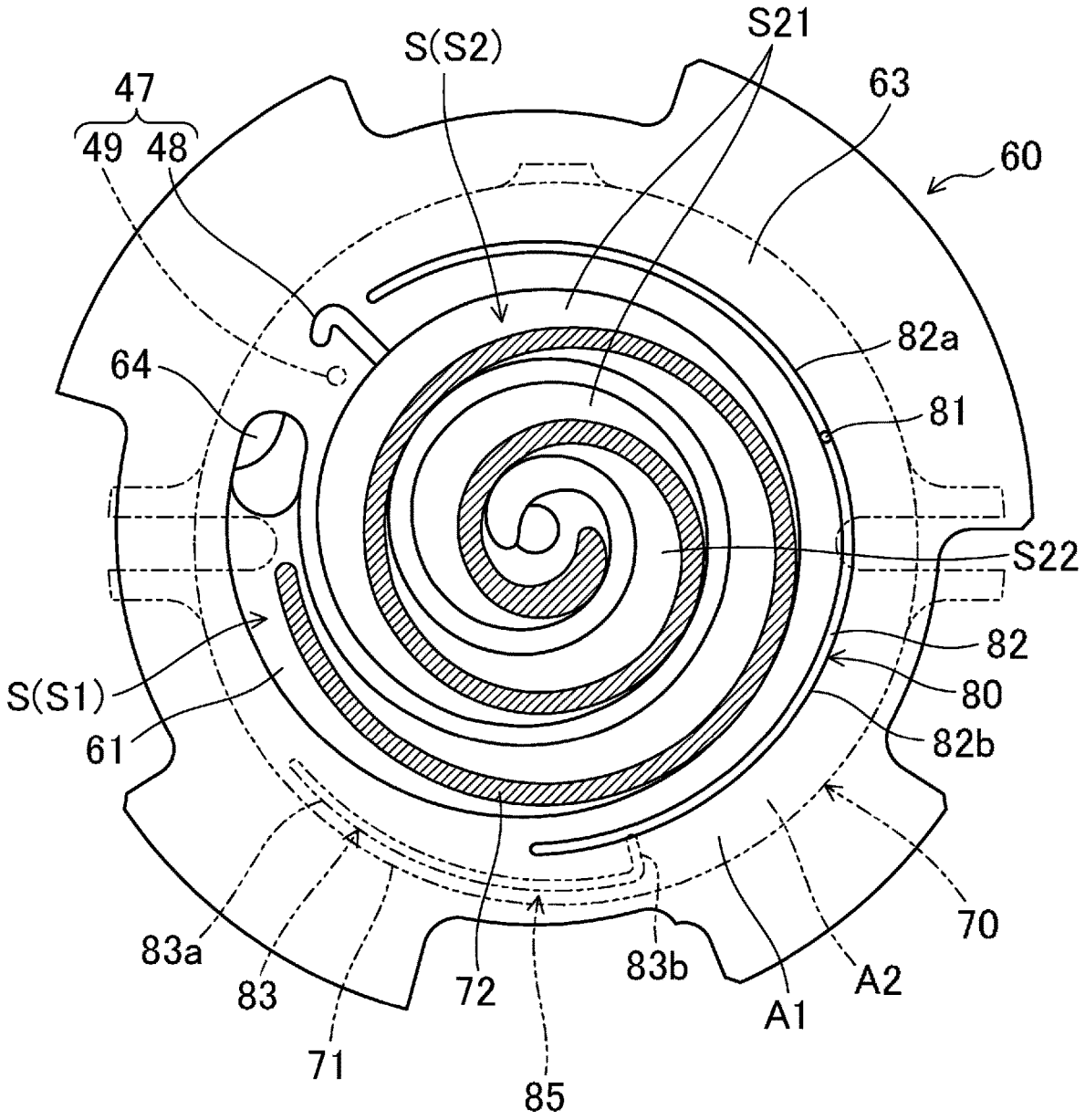
FIG. 5 is a cross-sectional view illustrating a third operation of the compression mechanism.

When the movable scroll (70) further rotates eccentrically from the state of FIG. 4 and reaches the crank angle θ=180° (540°) in FIG. 5, for example, the positional relationship between the fixed-side oil groove (80) and the movable-side oil groove (83) changes. Specifically, the tip of the communication groove (83*b*) moves diagonally upward to the right in the drawing from the position in FIG. 4 to the position in FIG. 5 on the orbit whose radius corresponds to the eccentric amount of the eccentric portion (15) of the drive shaft (11), and the tip of the communication groove (83*b*) keeps communicating with the fixed-side oil groove (80). Even in this state, therefore, as in the state of FIG. 3 where θ=0° (360°) and the state of FIG. 4 where θ=90° (450°), the high-pressure lubricating oil in the fixed-side oil groove (80) flows into the movable-side oil groove (83) through the communication groove (83*b*). As a result, the communication groove (83*b*) and the movable-side arc groove (83*a*) of the movable-side oil groove (83) are filled with the high-pressure lubricating oil. Also at this time, the movable-side oil groove (83) and the suction chamber (S1) are closed off from each other. Therefore, the high-pressure lubricating oil in the movable-side oil groove (83) is used to lubricate the fixed-side sliding surface (A1) and the movable-side sliding surface (A2).

Also at this time, the pressure inside the compression chamber (S2) is low, the movable scroll (70) is hard to overturn, the high pressure of the lubricating oil that has filled the fixed-side oil groove (80) and the movable-side oil groove (83) generates a relatively strong push-back force that pushes back the movable scroll (70) against the pressing force of the back pressure space (41), and the pressing force and the push-back force are still balanced.

Crank angle θ=225°(585°)

Figure 6:
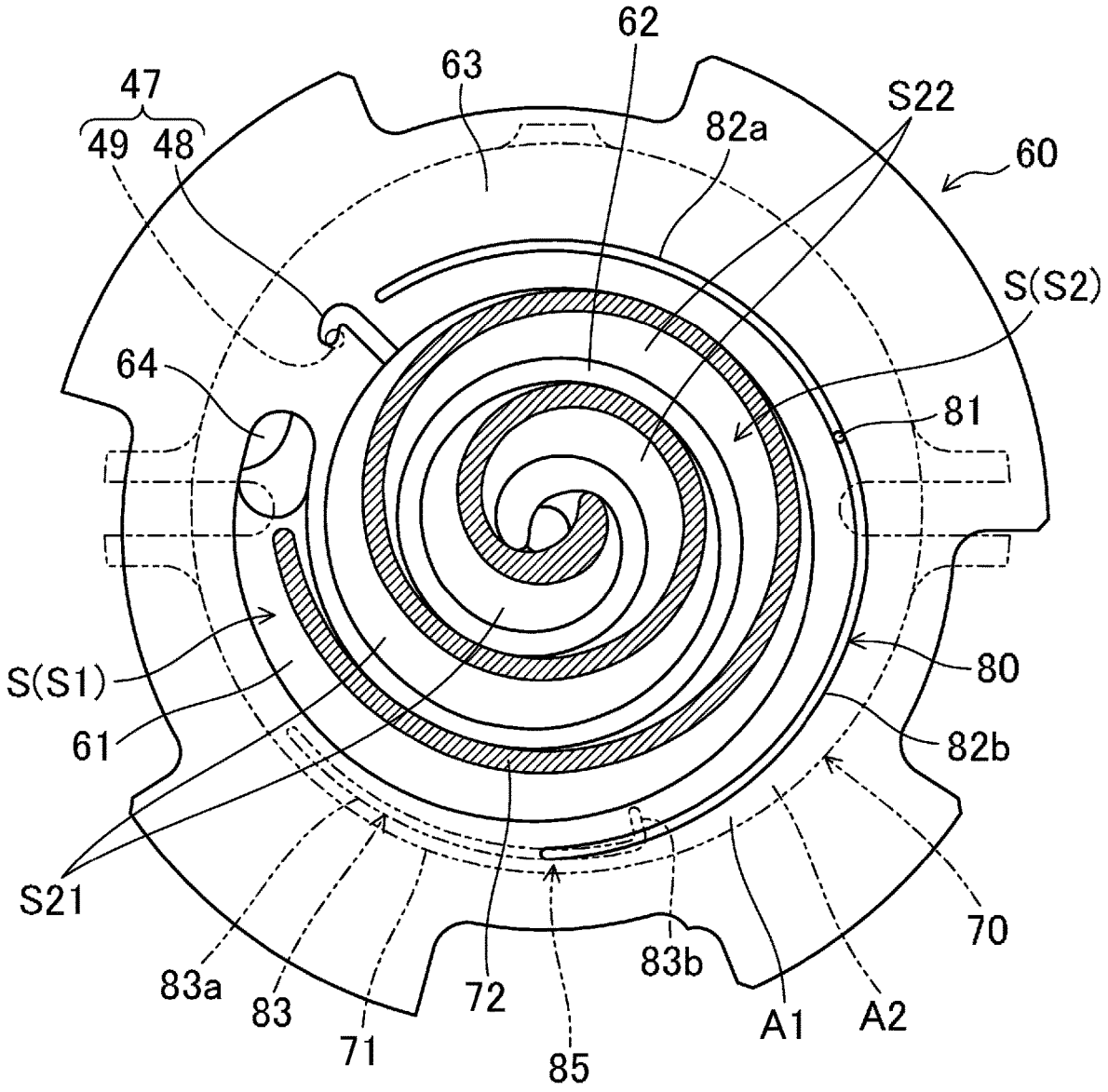
FIG. 6 is a cross-sectional view illustrating a fourth operation of the compression mechanism.

When the movable scroll (70) further rotates eccentrically from the state of FIG. 5 and reaches the crank angle θ=225° (585°) in FIG. 6, for example, the positional relationship between the fixed-side oil groove (80) and the movable-side oil groove (83) changes. Specifically, the tip of the communication groove (83*b*) moves diagonally upward to the left in the drawing from the position in FIG. 5 to the position in FIG. 6 on the orbit whose radius corresponds to the eccentric amount of the eccentric portion (15) of the drive shaft (11). At this time, the base end of the communication groove (83*b*) (the end connected to the movable-side arc groove (83*a*)) keeps communicating with the fixed-side oil groove (80), and the tip of the communication groove (83*b*) (the end opposite to the movable-side arc groove (83*a*)) is located at a position just before communicating with the suction chamber (S1). Even in this state, the high-pressure lubricating oil in the fixed-side oil groove (80) flows into the movable-side oil groove (83) through the communication groove (83*b*), and the communication groove (83*b*) and the movable-side arc groove (83*a*) of the movable-side oil groove (83) are filled with the high-pressure lubricating oil. Since the movable-side oil groove (83) and the suction chamber (S1) are still closed off from each other at this time, the high-pressure lubricating oil in the movable-side oil groove (83) is used to lubricate the fixed-side sliding surface (A1) and the movable-side sliding surface (A2).

Also at this time, the pressure inside the compression chamber (S2) is relatively low, the movable scroll (70) is hard to overturn, the high pressure of the lubricating oil that has filled the fixed-side oil groove (80) and the movable-side oil groove (83) generates a relatively strong push-back force that pushes back the movable scroll (70) against the pressing force of the back pressure space (41), and the pressing force and the push-back force are still balanced.

Crank angle θ=230°(590°)

In the present embodiment, when the crank angle advances by 5° from the state of FIG. 6 and reaches θ=230° (590°), the tip of the communication groove (83*b*) slightly moves diagonally upward to the left in the drawing from the position in FIG. 6 on the orbit whose radius corresponds to the eccentric amount of the eccentric portion (15) of the drive shaft (11). At this time, the tip of the communication groove (83*b*) communicates with the suction chamber (S1) and enters the communication section (α) illustrated in FIGS. 9 and 10 as in FIG. 7 described below.

In the communication section (α), the high-pressure lubricating oil flows into the suction chamber (S1) and therefore the pressures in the fixed-side oil groove (80) and the movable-side oil groove (83) decrease. Therefore, the push-back force that pushes back the movable scroll (70) against the pressing force of the back pressure space (41) weakens. At this time, the pressure in the compression chamber (S2) is high and the movable scroll (70) is likely to be overturned (at least a part of the movable scroll (70) moves away from the fixed scroll (60)). However, the pressing force becomes relatively large due to the push-back force weakening, and therefore the pressing force and the push-back force are balanced and the overturn motion is suppressed.

Crank angle θ=270°(630°)

Figure 7:
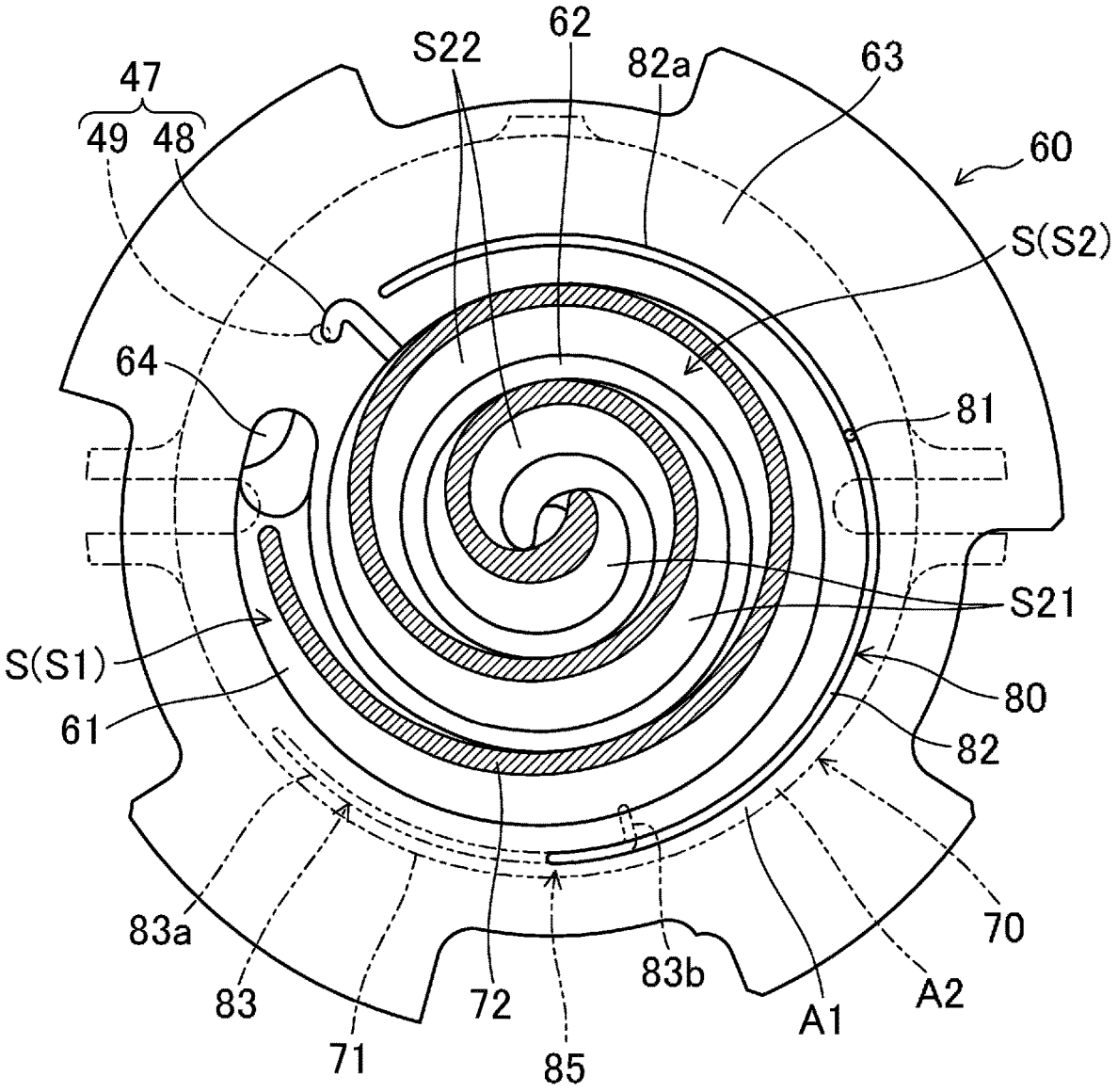
FIG. 7 is a cross-sectional view illustrating a fifth operation of the compression mechanism.

When the movable scroll (70) further rotates eccentrically and reaches the crank angle θ=270° (630°) in FIG. 7, for example, the tip of the communication groove (83*b*) further moves diagonally upward to the left in the drawing to the position in FIG. 7 on the orbit whose radius corresponds to the eccentric amount of the eccentric portion (15) of the drive shaft (11). At this time, the base end of the communication groove (83*b*) still communicates with the fixed-side oil groove (80) and the tip of the communication groove (83*b*) still communicates with the suction chamber (S1), and the communication section (α) continues.

In the communication section (α), as described above, the high-pressure lubricating oil flows into the suction chamber (S1) and therefore the pressures in the fixed-side oil groove (80) and the movable-side oil groove (83) decrease. Therefore, the push-back force that pushes back the movable scroll (70) against the pressing force of the back pressure space (41) weakens. At this time, the pressure in the compression chamber (S2) is high and the movable scroll (70) is likely to be overturned (at least a part of the movable scroll (70) moves away from the fixed scroll (60)). However, the pressing force becomes relatively large due to the push-back force weakening, and therefore the pressing force and the push-back force are balanced and the overturn motion is still suppressed.

Crank angle θ=315°(675°)

Figure 8:
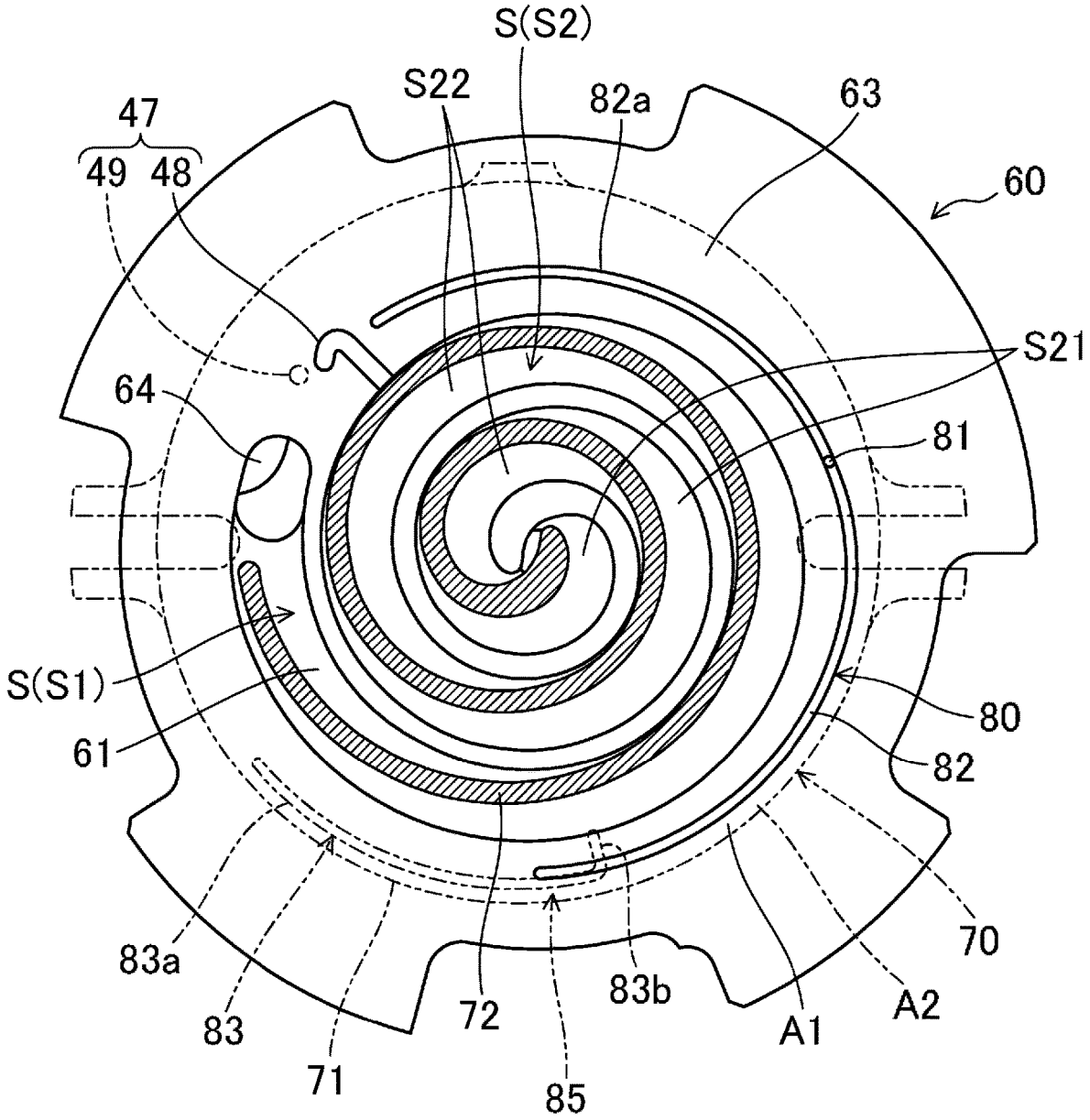
FIG. 8 is a cross-sectional view illustrating a sixth operation of the compression mechanism.

When the movable scroll (70) further rotates eccentrically and reaches the crank angle θ=315° (675°) in FIG. 8, for example, the tip of the communication groove (83*b*) moves diagonally downward to the left in the drawing from the position in FIG. 7 to the position in FIG. 8 on the orbit whose radius corresponds to the eccentric amount of the eccentric portion (15) of the drive shaft (11). At this time, the base end of the communication groove (83*b*) still communicates with the fixed-side oil groove (80) and the tip of the communication groove (83*b*) still communicates with the suction chamber (S1), and the communication section (α) continues. When the crank angle advances further by 5°, the tip of the communication groove (83*b*) separates from the suction chamber (S1), and the communication section (α) ends as illustrated in FIGS. 9 and 10.

In the communication section (α), as described above, the high-pressure lubricating oil flows into the suction chamber (S1) and therefore the pressures in the fixed-side oil groove (80) and the movable-side oil groove (83) decrease. Therefore, the push-back force that pushes back the movable scroll (70) against the pressing force of the back pressure space (41) weakens. At this time, the pressure in the compression chamber (S2) is high and the movable scroll (70) is likely to be overturned (at least a part of the movable scroll (70) moves away from the fixed scroll (60)). However, the pressing force becomes relatively large due to the push-back force weakening, and therefore the pressing force and the push-back force are balanced and the overturn motion is still suppressed.

Crank angle θ=320°(680°)

In the present embodiment, when the crank angle advances by 5° from the state of FIG. 8 and reaches θ=320° (680°), the tip of the communication groove (83*b*) slightly moves diagonally downward to the left in the drawing from the position in FIG. 8 on the orbit whose radius corresponds to the eccentric amount of the eccentric portion (15) of the drive shaft (11). At this time, the tip of the communication groove (83*b*) separates from the suction chamber (S1), and the communication section (α) ends.

When the communication section (α) ends, the high-pressure lubricating oil in the end of the second arc groove (82*b*) of the fixed-side oil groove (80) and in the fixed-side oil groove (80) flows into the movable-side oil groove (83) through the communication groove (83*b*), but not into the suction chamber (S1). As a result, the communication groove (83*b*) and the movable-side arc groove (83*a*) of the movable-side oil groove (83) are filled with the high-pressure lubricating oil. At this time, the movable-side oil groove (83) and the suction chamber (S1) are closed off from each other. Therefore, the high-pressure lubricating oil in the movable-side oil groove (83) is used to lubricate the fixed-side sliding surface (A1) and the movable-side sliding surface (A2).

The movable scroll (70) then returns to the state of FIG. 3 where the crank angle θ=0° (360°). This decreases the pressure inside the compression chamber (S2) and makes it difficult to overturn the movable scroll (70). The high pressure of the lubricating oil that has filled the fixed-side oil groove (80) and the movable-side oil groove (83) generates a relatively strong push-back force that pushes back the movable scroll (70) against the pressing force of the back pressure space (41), and the pressing force and the push-back force are balanced to avoid excessive pressing.

Thereafter, the movable scroll (70) repeats the state of FIG. 3 where the crank angle θ=0° (360°) to the state of FIG. 8 where the crank angle θ=315° (675°) in that order. When the movable scroll (70) is likely to be overturned, the movable scroll (70) enters the communication section (α) and the pressing force becomes relatively strong, and therefore the overturn motion is suppressed. In other sections, the pressing force becomes relatively weak and excessive pressing is suppressed.

Effects of First Embodiment

In the present embodiment, the scroll compressor (10) includes the compression mechanism (40) having an asymmetric spiral structure, and the fluid chamber (S) having the different discharge start points (D1, D2) between the first compression chamber (S21) and the second compression chamber (S22). This scroll compressor (10) is provided with the adjustment mechanism (85). The adjustment mechanism (85) includes the oil inflow groove (80) that is formed in the fixed-side sliding surface (A1) and into which high-pressure lubricating oil flows, and the oil relief passage (83). The oil relief passage (83) includes the communication portion (83*b*) that is formed in the movable-side sliding surface (A2) such that the communication portion (83*b*) communicates with the oil inflow groove (80) and allows oil to flow into the suction chamber (S1) in the communication section (α). The start point (P1) of the communication section (α) of the adjustment mechanism (85) is set between the discharge start point (D1) of the first compression chamber (S21) and the discharge start point (D2) of the second compression chamber (S22) during the eccentric rotational motion of the movable scroll (70), and the end point (P2) of the communication section (α) is set after the discharge start of the second compression chamber (S22).

With this configuration, according to the present embodiment, the high-pressure lubricating oil in the oil inflow groove (80) flows into the low-pressure space (S1) through the oil relief passage (83) in the communication section (α) during the eccentric rotation of the movable scroll (70), that is, in a section where the pressure in the fluid chamber (S) is relatively high during the discharge stroke (section where the movable scroll (70) is likely to be overturned), not in a section where the pressure in the fluid chamber (S) is low before the compression stroke.

In the conventional compressor, the lubricating oil in the oil inflow groove is supplied into the fluid chamber (suction chamber) before compression. Therefore, the lubricating oil, which generates the push-back force acting against the pressing force that presses the movable scroll against the fixed scroll, in the oil inflow groove flows into the suction chamber in a large amount. As a result, the pressure in the oil inflow groove may decrease and excessive pressing may cause friction loss. Conversely, if the oil is supplied to the oil inflow groove in a limited amount, the pressing force may be insufficient and the movable scroll may be overturned. In this manner, the behavior of the movable scroll may become unstable.

In the present embodiment, on the other hand, the pressure in the oil inflow groove (80) decreases and the push-back force that pushes back the movable scroll (70) from the fixed scroll (60) weakens in the communication section (α) where the lubricating oil flows from the oil inflow groove (80) to the low-pressure space (S1). Therefore, it is possible to weaken the push-back force and to suppress the insufficient pressing in a rotation range (communication section (α)) where the push-back force tends to be stronger than the pressing force and the overturn motion is likely to occur. Conversely, the high-pressure lubricating oil is retained in the oil inflow groove (80) in a section, other than the communication section (α), where the pressure in the fluid chamber (S) is relatively low. This makes it possible to suppress the pressing force becoming too strong relative to the push-back force, and to suppress the occurrence of friction loss due to excessive pressing.

As described above, the present embodiment makes it possible to stabilize the behavior of the movable scroll (70) during the eccentric rotation.

In the present embodiment, the oil inflow groove (80) is formed in the fixed-side sliding surface (A1), while the oil relief passage (83) is formed in the movable-side sliding surface (A2). Conversely, for example, the oil inflow groove (80) may be formed in the movable-side sliding surface (A2) and the oil relief passage (83) may be formed in the fixed-side sliding surface (A1). In this case, the oil inflow groove (80) moves around the fluid chamber (S) with the same orbiting radius as the movable scroll (70) as the movable scroll (70) rotates eccentrically. In that case, the area of the fixed-side sliding surface (A1) becomes large and the compression mechanism (40) also tends to become large, such that the oil inflow groove (80) does not communicate with the fluid chamber (S) directly at any crank angle of the movable scroll (70). According to the present embodiment, on the other hand, the oil inflow groove (80) is formed in the fixed-side sliding surface (A1) while the oil relief passage (83) is formed in the movable-side sliding surface (A2). This makes it possible to suppress an increase in size of the compression mechanism with a simple structure.

In the present embodiment, the oil relief groove (83) formed in the movable-side sliding surface (A2) is configured to communicate with the suction chamber (S1) of the fluid chamber (S) in the communication section (α). With this configuration, the high-pressure lubricating oil in the fixed-side oil groove (80) just needs to flow into the suction chamber (S1) located near the fixed-side oil groove, making it possible to implement, with a simple configuration, a mechanism that stabilizes the behavior of the movable scroll (70).

In the present embodiment, the oil inflow groove (80) is formed in a range of slightly wider than 180° in the circumferential direction with respect to the center of the fixed-side end plate (61) or the movable-side end plate (71). If this angular range is too narrow or too wide, it becomes difficult for the high-pressure oil in the oil inflow groove (80) to flow into the low-pressure space, and difficult to stabilize the behavior of the movable scroll. According to the present embodiment, however, a configuration that stabilizes the behavior of the movable scroll can be implemented relatively easily.

In the present embodiment, the discharge start point (D2) of the second compression chamber (S22) is set in the first half of the communication section (α) during the eccentric rotational motion of the movable scroll (70). With this configuration, the communication section does not end while the pressure in the compression chamber (S2) is the discharge pressure. Therefore, it is possible to weaken the push-back force without fail when the movable scroll (70) is likely to be overturned. This makes it possible to suppress the pressing force becoming insufficient in the communication section, making it easy to stabilize the behavior of the movable scroll (70).

In the present embodiment, the flow path cross-sectional area of the oil relief groove (83) is smaller than the flow path cross-sectional area of the oil inflow groove (80). This configuration makes it possible to limit the flow rate of the lubricating oil flowing from the oil inflow groove (80) to the low-pressure space (S1) through the oil relief passage (83). Therefore, it is possible to stabilize the behavior of the movable scroll (70) by adjusting the push-back force in the communication section (α) and balancing the pressing force and the push-back force within a suitable range.

Modification of First Embodiment

In the first embodiment, the oil inflow groove (80) is formed in the fixed-side sliding surface (A1), while the communication groove (83*b*) of the oil relief groove (83) is formed in the movable-side sliding surface (A2). Conversely, for example, the oil inflow groove (80) may be formed in the movable-side sliding surface (A2), while the communication groove (83*b*) of the oil relief groove (83) may be formed in the fixed-side sliding surface (A1).

Second Embodiment

A second embodiment illustrated in FIGS. 11 to 14 will be described.

In the second embodiment, unlike the first embodiment, a fixed-side oil groove (oil inflow groove) (80) is formed in an angular range (about three quarters of the circumference around the fluid chamber (S)) wide enough to include the fixed-side oil groove (80) and the movable-side oil groove (83) formed in the first embodiment, and the movable-side oil groove (83) is not formed. In the second embodiment, an oil relief passage (83) is constituted by a through hole (83*c*) that penetrates the movable-side end plate (71) from the movable-side sliding surface (A2) to the rear surface, not by the movable-side oil groove (83) of the first embodiment. This through hole (83*c*) is configured to communicate, in the communication section (α), with a second back pressure portion (back pressure chamber) (43) having a pressure lower than the discharge pressure of the compression chamber (S2) in the back pressure space (41) formed on the rear surface of the movable-side end plate (71).

The other configurations are similar to those of the first embodiment. Although the first oil passage (55), the second oil passage (56), the third oil passage (57), the fourth oil passage (58), and the vertical hole (81) are not illustrated in FIG. 11, the illustration thereof on the drawing is merely omitted and these are actually formed in the same manner as the first embodiment in FIG. 2.

Also in the second embodiment, the communication section (α) has a crank angle θ set in the range of 230° (590°) to 320° (680°) illustrated in FIGS. 9 and 10 as in the first embodiment. That is, FIG. 12 illustrates a state immediately before the crank angle θ enters the communication section (α) (5° before the section), FIG. 13 illustrates a state where the crank angle θ is in the communication section (α), and FIG. 14 illustrates a state where the crank angle θ is immediately before the end of the communication section (α) (5° before the end of the section).

Figure 12:
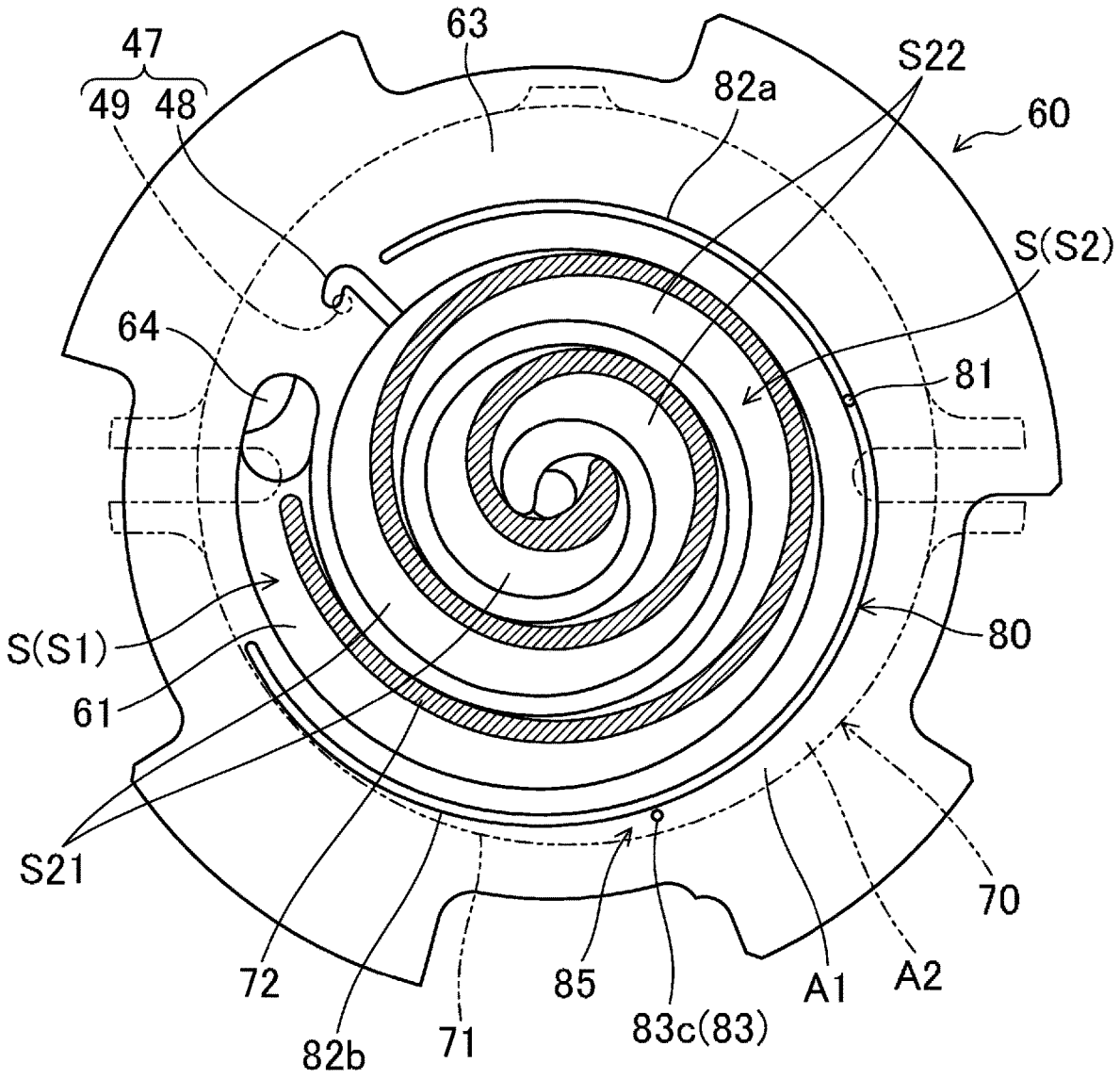
FIG. 12 is a cross-sectional view illustrating a first operation of the compression mechanism.
Figure 13:
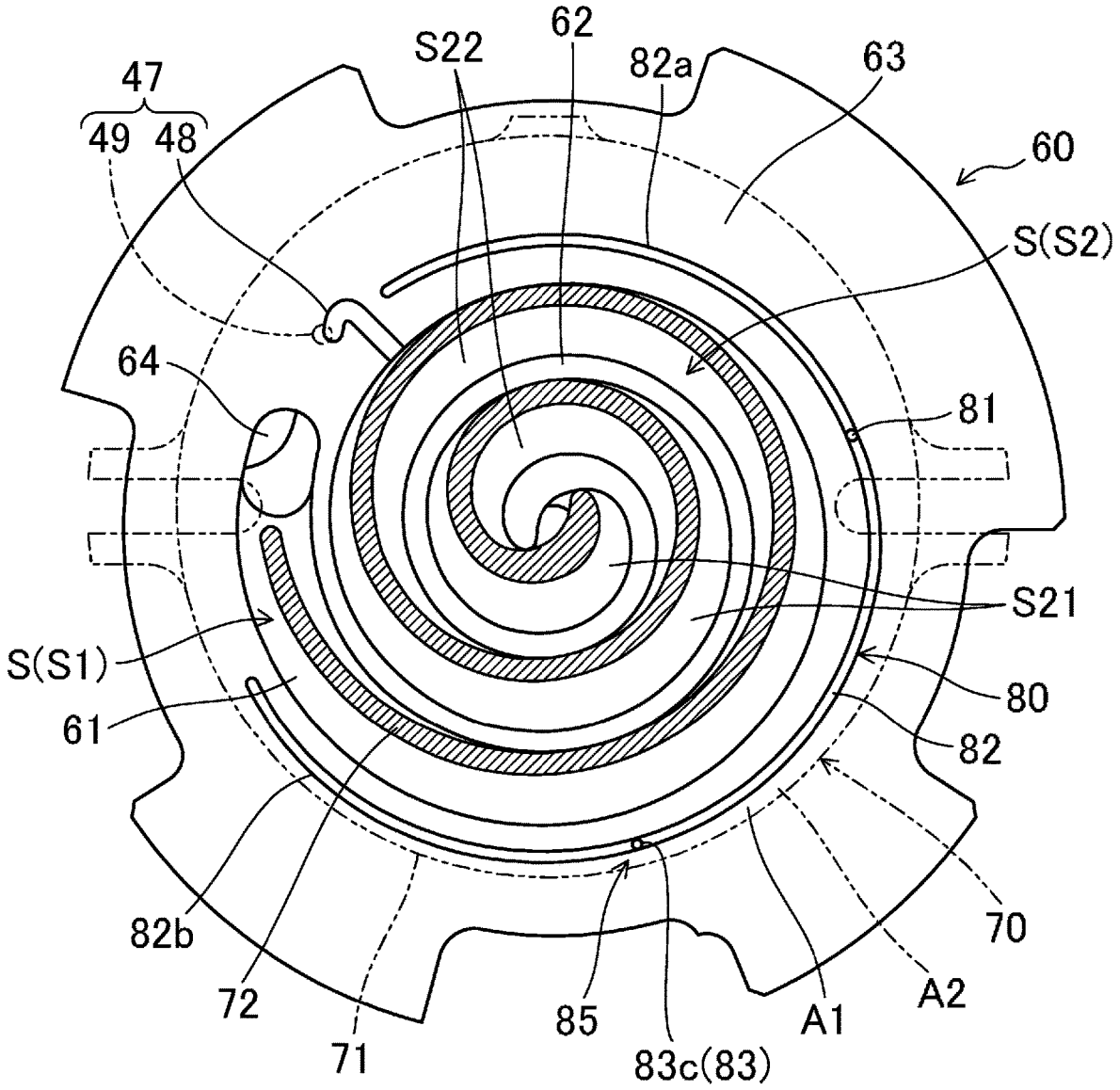
FIG. 13 is a cross-sectional view illustrating a second operation of the compression mechanism.

Therefore, the fixed-side oil groove (80) and the through hole (83*c*) do not communicate with each other while the crank angle θ is from 0° (360°) (not illustrated) to 225° (585°) in FIG. 12. The fixed-side oil groove (80) is therefore filled with the high-pressure lubricating oil and has a high pressure, thereby generating a relatively strong push-back force. Excessive pressing is thus suppressed.

When the crank angle θ advances by 5° from the state of FIG. 12, the crank angle θ enters the communication section (α) where the fixed-side oil groove (80) and the through hole (83*c*) communicate with each other. The communication section (α) continues from) 230° (590°) to 320° (680°) as described above and, in that section, the lubricating oil in the fixed-side oil groove (80) flows into the second back pressure portion (43) having an intermediate pressure. Therefore, in the states illustrated in FIGS. 13 and 14, the pressure inside the fixed-side oil groove (80) decreases, and the push-back force also weakens. Therefore, the pressing force that presses the movable scroll (70) against the fixed scroll (60) becomes relatively strong, and the overturn motion of the movable scroll is suppressed.

Figure 14:
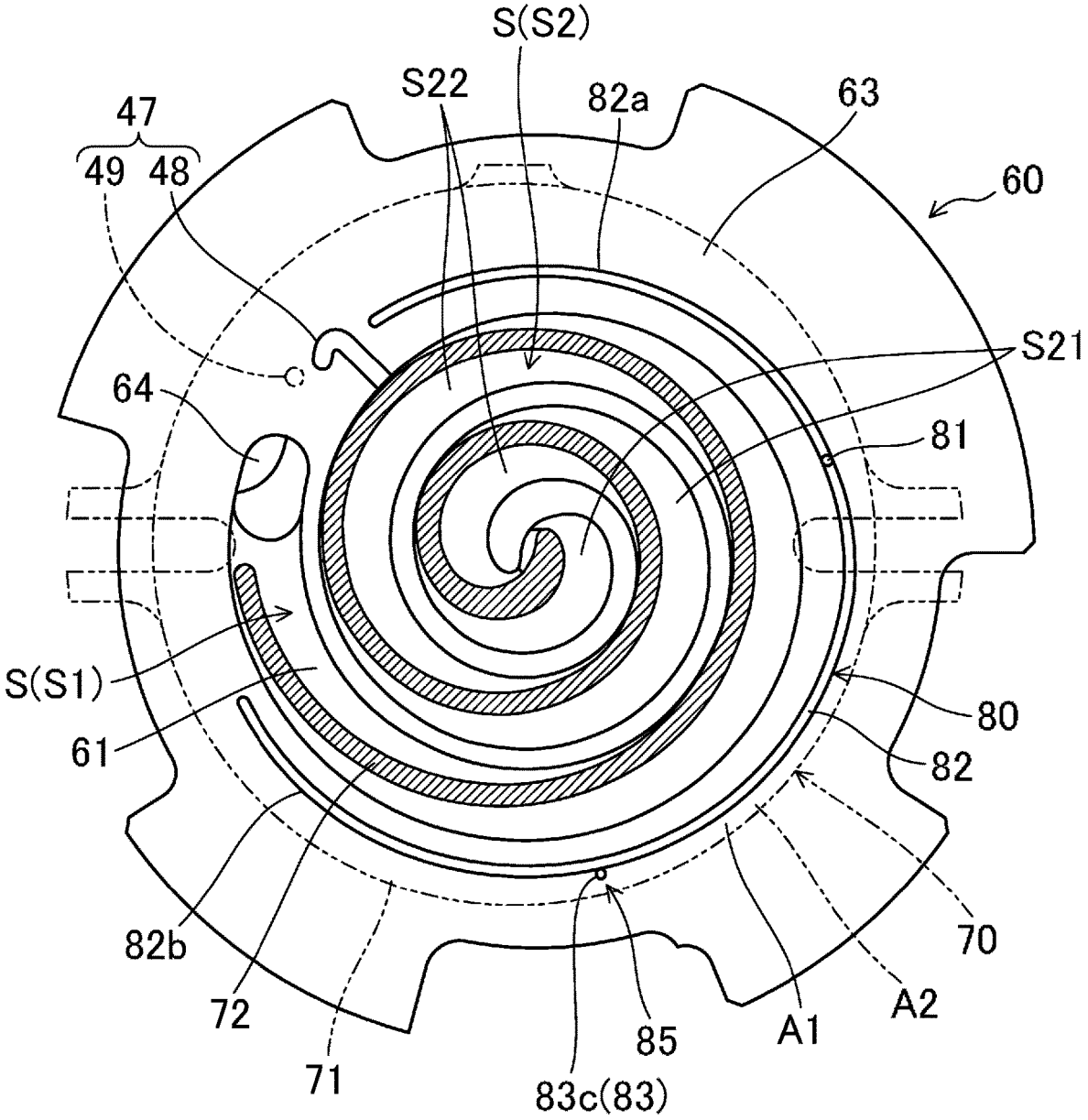
FIG. 14 is a cross-sectional view illustrating a third operation of the compression mechanism.

When the crank angle θ advances by 5° from the state of FIG. 14, the through hole (83*c*) separates from the fixed-side oil groove (80), and the communication section (α) ends. This state continues until the crank angle returns to 0° (360°) and again reaches 230° (590°), during which the fixed-side oil groove (80) is filled with the high-pressure oil.

Also in the second embodiment, as in the first embodiment, when the movable scroll (70) is likely to be overturned, the movable scroll (70) enters the communication section (α) and the pressing force becomes relatively strong, and therefore the overturn motion is suppressed. In other sections, the pressing force becomes relatively weak and excessive pressing is suppressed.

Effects of Second Embodiment

In the second embodiment, the oil relief passage (83) is constituted by the through hole (83*c*) that penetrates the movable-side end plate (71) from the movable-side sliding surface (A2) to the rear surface, and the oil relief passage (83) communicates with the second back pressure portion (back pressure chamber) (43) provided on the rear surface of the movable-side end plate (71) in the communication section (α).

With this configuration, in the communication section (α), the high-pressure lubricating oil in the oil inflow groove (80) of the fixed-side sliding surface (A1) flows into the back pressure chamber (43) through the through hole (83*c*) that passes from the movable-side sliding surface (A2) to the rear surface. As a result, the pressure in the oil inflow groove (80) decreases and the push-back force weakens. Therefore, it is possible to suppress the insufficient pressing force in the predetermined rotation range (communication section (α)) of the movable scroll (70), and to suppress excessive pressing in other sections.

Also in the second embodiment, therefore, the behavior of the movable scroll (70) can be stabilized as in the first embodiment. In the second embodiment, the through hole (83*c*) is provided as an oil relief passage instead of the movable-side oil groove (83), so that the configuration can be simplified as compared with the first embodiment.

OTHER EMBODIMENTS

For example, the above embodiments may adopt the following configurations.

For example, in the first embodiment, the fixed-side oil groove (80) is formed in an angular range of slightly wider than 180° in the circumferential direction with respect to the center of the fixed-side end plate (61) or the movable-side end plate (71). However, this angular range does not necessarily need to be wider than 180°, and can be appropriately set with respect to the center. However, if the angular range is too narrow, it is difficult to stabilize the behavior of the movable scroll. It is therefore preferable that the angular range be 180° or more in the circumferential direction with respect to the center.

In the first embodiment, the oil relief passage (83) is constituted by the movable-side oil groove (83) formed in the movable-side sliding surface (A2), and the movable-side oil groove (83) is configured to communicate with the suction chamber (low-pressure space) (S1) of the fluid chamber (S) in the communication section (α). However, the low-pressure space that communicates with the oil relief passage (83) in the communication section (α) is not limited to the suction chamber (S1), but may be another space as long as the space is a low-pressure space inside the scroll compressor (10).

In the above embodiments, the discharge start point (D2) of the second compression chamber (S22) is set in the first half of the communication section (α) during the eccentric rotational motion of the movable scroll (70). However, for example, the position of the discharge start point (D2) of the second compression chamber (S22) may be appropriately changed within the range of the communication section (α).

In the above embodiments, the flow path cross-sectional area of the oil relief passage (83) is smaller than the flow path cross-sectional area of the oil groove (80), but the flow path cross-sectional area of the oil relief passage (83) does not necessarily need to be smaller than the flow path cross-sectional area of the oil groove (80).

The specific angular range of the communication section (α) described in the above embodiments is an example. The angular range of the communication section (α) can appropriately be set based on a range where the movable scroll (70) is likely to be overturned, the range being determined for the individual spiral structures of the fixed scroll (60) and the movable scroll (70) to which the structure of the present disclosure is applied.

The foregoing description concerns the embodiments and modifications, and it will be understood that numerous variations of forms and details may be made without departing from the gist and scope of the appended claims. The foregoing embodiments and modifications may be combined with one another or features thereof may be replaced with one another, as long as it does not impair the features of the present disclosure.

As described above, the present disclosure is useful for a scroll compressor.

The invention claimed is:

1. A scroll compressor comprising:

a casing;

a low-pressure space inside the casing; and a compression mechanism housed in the casing, the compression mechanism including a fixed scroll including a fixed-side end plate having a disk shape, and a fixed-side wrap having a spiral shape and rising from the fixed-side end plate, the fixed scroll being fixed to the casing, a movable scroll including a movable-side end plate having a disk shape that substantially slides on the fixed-side end plate, and a movable-side wrap having a spiral shape that rises from the movable-side end plate and has a different circumferential length from the fixed-side wrap, the movable scroll being configured to make an eccentric rotational motion with respect to the fixed scroll while meshing with the fixed scroll, a fluid chamber including a first compression chamber formed between an inner peripheral surface of the fixed-side wrap and an outer peripheral surface of the movable-side wrap, and a second compression chamber formed between an outer peripheral surface of the fixed-side wrap and an inner peripheral surface of the movable-side wrap, the first compression chamber having a first discharge start point, and the second compression chamber having a second discharge start point, and an adjustment mechanism including an oil inflow groove formed in one of a fixed-side sliding surface and a movable-side sliding surface where the fixed-side end plate and the movable-side end plate slide with each other, and an oil relief passage formed in an other one of the fixed-side sliding surface and the movable-side sliding surface, high-pressure lubricating oil flowing into the oil inflow groove, the oil relief passage including a communication portion that communicates with the oil inflow groove in a predetermined angular range in a circumferential direction during eccentric rotation of the movable scroll, the lubricating oil flowing from the oil inflow groove into the low-pressure space through the communication portion, the first discharge start point being a first angular position of the movable scroll along the eccentric rotational motion of the movable scroll when the first compression chamber starts to discharge compressed refrigerant, the second discharge start point being a second angular position of the movable scroll along the eccentric rotational motion of the movable scroll when the second compression chamber starts to discharge compressed refrigerant, and the first and second discharge start points being angularly spaced from each other so that the first discharge start point occurs before the second discharge start point during the eccentric rotational motion of the movable scroll, and a start point of the predetermined angular range being angularly positioned between the first discharge start point of the first compression chamber and the second discharge start point of the second compression chamber along the eccentric rotational motion of the movable scroll, an end point of the predetermined angular range being angularly positioned after the second discharge start point of the second compression chamber, the start point being formed at one end of the predetermined angular range in the circumferential direction, and the end point being formed at an other end of the predetermined angular range in the circumferential direction.

2. The scroll compressor according to claim 1, wherein the oil inflow groove is formed in the fixed-side sliding surface, and the communication portion of the oil relief passage is formed in the movable-side sliding surface.

3. The scroll compressor according to claim 2, wherein the oil relief passage is formed by an oil relief groove formed in the movable-side sliding surface, and the oil relief passage is configured to communicate with a suction chamber included in the fluid chamber in the predetermined angular range.

4. The scroll compressor according to claim 3, wherein the oil inflow groove is formed in an angular range of 180° or more in the circumferential direction with respect to a center of the fixed-side end plate or the movable-side end plate.

5. The scroll compressor according to claim 3, wherein the second discharge start point of the second compression chamber is set in a first half of the predetermined angular range during the eccentric rotational motion of the movable scroll.

6. The scroll compressor according to claim 3, wherein a flow path cross-sectional area of the oil relief passage is smaller than a flow path cross-sectional area of the oil inflow groove.

7. The scroll compressor according to claim 2, wherein the oil relief passage is formed by a through hole that penetrates the movable-side end plate from the movable-side sliding surface to a rear surface of the movable-side end plate, and a back pressure chamber having a pressure lower than a discharge pressure of the fluid chamber is formed on the rear surface of the movable-side end plate.

8. The scroll compressor according to claim 7, wherein the oil inflow groove is formed in an angular range of 180° or more in the circumferential direction with respect to a center of the fixed-side end plate or the movable-side end plate.

9. The scroll compressor according to claim 7, wherein the second discharge start point of the second compression chamber is set in a first half of the predetermined angular range during the eccentric rotational motion of the movable scroll.

10. The scroll compressor according to claim 7, wherein a flow path cross-sectional area of the oil relief passage is smaller than a flow path cross-sectional area of the oil inflow groove.

11. The scroll compressor according to claim 2, wherein the oil inflow groove is formed in an angular range of 180° or more in the circumferential direction with respect to a center of the fixed-side end plate or the movable-side end plate.

12. The scroll compressor according to claim 2, wherein the second discharge start point of the second compression chamber is set in a first half of the predetermined angular range during the eccentric rotational motion of the movable scroll.

13. The scroll compressor according to claim 2, wherein a flow path cross-sectional area of the oil relief passage is smaller than a flow path cross-sectional area of the oil inflow groove.

14. The scroll compressor according to claim 1, wherein the oil inflow groove is formed in an angular range of 180° or more in the circumferential direction with respect to a center of the fixed-side end plate or the movable-side end plate.

15. The scroll compressor according to claim 14, wherein the second discharge start point of the second compression chamber is set in a first half of the predetermined angular range during the eccentric rotational motion of the movable scroll.

16. The scroll compressor according to claim 14, wherein a flow path cross-sectional area of the oil relief passage is smaller than a flow path cross-sectional area of the oil inflow groove.

17. The scroll compressor according to claim 1, wherein the second discharge start point of the second compression chamber is set in a first half of the predetermined angular range during the eccentric rotational motion of the movable scroll.

18. The scroll compressor according to claim 17, wherein a flow path cross-sectional area of the oil relief passage is smaller than a flow path cross-sectional area of the oil inflow groove.

19. The scroll compressor according to claim 1, wherein a flow path cross-sectional area of the oil relief passage is smaller than a flow path cross-sectional area of the oil inflow groove.

* * * * *